US009358802B2

(12) United States Patent
Akahane et al.

(10) Patent No.: US 9,358,802 B2
(45) Date of Patent: Jun. 7, 2016

(54) LIQUID EJECTING HEAD, LIQUID EJECTING APPARATUS, FLOW PASSAGE MEMBER, AND METHOD OF CONTROLLING LIQUID EJECTING HEAD

(71) Applicant: SEIKO EPSON CORPORATION, Tokyo (JP)

(72) Inventors: Fujio Akahane, Azumino (JP); Yasuyuki Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/665,510

(22) Filed: Mar. 23, 2015

(65) Prior Publication Data

US 2015/0273851 A1 Oct. 1, 2015

(30) Foreign Application Priority Data

| | | |
|---|---|---|
| Mar. 28, 2014 | (JP) | 2014-070160 |
| Mar. 28, 2014 | (JP) | 2014-070161 |
| Mar. 28, 2014 | (JP) | 2014-070162 |
| Mar. 28, 2014 | (JP) | 2014-070163 |
| Oct. 17, 2014 | (JP) | 2014-212492 |

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC .... B41J 2/175; B41J 2/17509; B41J 2/17513; B41J 2/17553; B41J 2/17596
USPC ..... 347/30, 85
See application file for complete search history.

(56) References Cited

U.S. PATENT DOCUMENTS

| | | | | |
|---|---|---|---|---|
| 5,557,306 | A | 9/1996 | Fukushima et al. | |
| 7,083,253 | B2 | 8/2006 | Kimura et al. | |
| 2005/0151804 | A1 | 7/2005 | Hayashi et al. | |
| 2006/0066698 | A1 * | 3/2006 | Takatsuka | B41J 2/18 347/93 |
| 2007/0126816 | A1 | 6/2007 | Nishida | |
| 2008/0007579 | A1 | 1/2008 | Furukawa et al. | |
| 2010/0238240 | A1 | 9/2010 | Yokouchi et al. | |
| 2010/0245465 | A1 * | 9/2010 | Nakamura | B41J 2/1652 347/30 |
| 2010/0245498 | A1 * | 9/2010 | Koizumi | B41J 2/16532 347/85 |
| 2011/0074873 | A1 * | 3/2011 | Ito | B41J 2/17596 347/30 |
| 2011/0093900 | A1 | 4/2011 | Patel et al. | |
| 2011/0193914 | A1 | 8/2011 | Yamada et al. | |
| 2011/0292136 | A1 | 12/2011 | Kurebayashi et al. | |
| 2012/0194608 | A1 | 8/2012 | Matsumoto et al. | |

FOREIGN PATENT DOCUMENTS

| | | |
|---|---|---|
| EP | 1 452 320 | 9/2004 |
| JP | 07-096604 | 4/1995 |
| JP | 2003-136742 | 5/2003 |
| JP | 2004-291618 | 10/2004 |
| JP | 2006-082538 | 3/2006 |
| JP | 2007-152725 | 6/2007 |
| JP | 2007-185905 | 7/2007 |
| JP | 2011-121257 | 6/2011 |
| JP | 2011-161827 | 8/2011 |
| JP | 2011-161844 | 8/2011 |
| JP | 2011-245679 | 12/2011 |
| JP | 2012-116144 | 6/2012 |
| JP | 2012-158002 | 8/2012 |

OTHER PUBLICATIONS

European Search Report for Application No. 15161008.6 dated Nov. 9, 2015.

* cited by examiner

*Primary Examiner* — Manish S Shah
*Assistant Examiner* — Roger W Pisha, II
(74) *Attorney, Agent, or Firm* — Workman Nydegger

(57) ABSTRACT

A flow passage member is used in a liquid ejecting head including an ejecting unit. The ejecting unit communicates with a self-sealing unit which is a negative pressure generation mechanism. The flow passage member includes a flow passage internal pressure adjustment mechanism that adjusts a pressure inside a flow passage between the self-sealing unit and the ejecting unit by changing a volume of the flow passage on a way of the flow passage and a flow passage opening and closing mechanism that opens and closes the flow passage on a way of a flow passage between the self-sealing unit and the flow passage internal pressure adjustment mechanism.

21 Claims, 16 Drawing Sheets

LIQUID EJECTING HEAD, LIQUID EJECTING APPARATUS, FLOW PASSAGE MEMBER, AND METHOD OF CONTROLLING LIQUID EJECTING HEAD

CROSS-REFERENCE TO RELATED APPLICATIONS

This application claims priority to Japanese Patent Application No. 2014-070160 filed on Mar. 28, 2014, Japanese Patent Application No. 2014-070161 filed on Mar. 28, 2014, Japanese Patent Application No. 2014-070162 filed on Mar. 28, 2014, Japanese Patent Application No. 2014-070163 filed on Mar. 28, 2014 and Japanese Patent Application No. 2014-212492 filed on Oct. 17, 2014. The entire disclosures of Japanese Patent Application Nos. 2014-070160, 2014-070161, 2014-070162, 2014-070163 and 2014-212492 are hereby incorporated herein by reference.

BACKGROUND

1. Technical Field

The present invention relates to a liquid ejecting head, a liquid ejecting apparatus, and a method of controlling the liquid ejecting head, and particularly to, a liquid ejecting head, a liquid ejecting apparatus, and a method of controlling the liquid ejecting head effectively applied when a flow passage opening and closing mechanism and a flow passage internal pressure adjustment mechanism are provided in a liquid flow passage of the liquid ejecting head from a liquid supply source.

2. Related Art

As representative examples of liquid ejecting heads ejecting liquid droplets, ink jet recording heads ejecting ink droplets can be exemplified. As the ink jet recording heads, for example, there have been proposed ink jet recording heads including head bodies which eject ink droplets from nozzle openings and flow passage members to which the head bodies are fixed, to which ink is supplied from ink cartridges storing ink, and which supply the ink from the ink cartridges to the head bodies. In such types of ink jet recording heads, back pressures inside heads (reservoirs or pressure chambers) are generally maintained to be negative pressures in order to manage meniscus positions at positions at which continuous ejection is handled. However, there is a concern of bubbles near the nozzle openings being drawn to the nozzle openings due to the negative pressures at the time of wiping or the like. When the bubbles are drawn to the nozzle openings, nozzle clogging may occur.

Accordingly, it is necessary to release the negative pressures when the time of wiping or the like is necessary. For this reason, there has been proposed a liquid ejecting apparatus in which an eccentric cam is disposed as a pressurization mechanism in a side of a flow passage between a negative pressure generation mechanism (difference pressure valve) and a head and the inside of the head is pressurized by the pressurization mechanism via the eccentric cam at the time of wiping (see JP-A-2011-161827). There is also a liquid ejecting apparatus in which a bypass flow passage for pressurization supply is installed and a pressure is applied directly to the inside of the head by a pressurization pump (see JP-A-2011-161844)

However, in JP-A-2011-161827, the volume of the flow passage is changed by bringing the eccentric cam into contact with a tube. Therefore, when the number of nozzles increases, for example, branches are formed downstream from the flow passage, it is difficult to perform a necessary volume change.

On the other hand, when the tube is thickened to obtain a large volume change, a flow rate is lowered as the tube is thickened, and thus an exhaust property may deteriorate.

In JP-A-2011-161844, it is difficult to minutely adjust the amount of liquid to be supplied and many fluids may be unnecessarily wasted.

In a liquid ejecting head including a negative pressure generation mechanism for each kind of liquid and a valve (in other words, the valve corresponds to a flow passage opening and closing mechanism) that opens and closes a flow passage for each kind of liquid, when each component is distributed and disposed for each kind of liquid, the size of the liquid ejecting head may be increased. That is, it is necessary to contrive and rationalize the layout of each component. Accordingly, particularly in the liquid ejecting head including the plurality of negative pressure generation mechanisms or the plurality of flow passage opening and closing mechanisms for respective colors, a problem is to develop a reasonable disposition layout as a whole.

When a flow passage internal pressure adjustment mechanism is individually installed for each color inside a flow passage in order to release a negative pressure at the normal time, the size of a flow passage member may be increased. Accordingly, it is necessary to contrive the layout of each component, to begin with, from the flow passage internal pressure adjustment mechanism.

It may be difficult to release a negative pressure temporarily with wiping or the like and form a meniscus proper to a nozzle opening again after end of a wiping work in some cases.

Such problems similarly occur not only in flow passage members used in liquid ejecting heads such as ink jet recording heads but also in flow passage members used in devices other than the liquid ejecting heads.

SUMMARY

An advantage of some aspects of the invention is that it provides a flow passage member, a liquid ejecting head, and a liquid ejecting apparatus capable of controlling the volume of a flow passage efficiently and highly accurately.

Another advantage of some aspects of the invention is that it also provides a liquid ejecting head and a liquid ejecting apparatus in which components can be disposed reasonably from the viewpoint of space saving and low cost.

Still another advantage of some aspects of the invention is that it also provides a flow passage member, a liquid ejecting head, and a liquid ejecting apparatus capable of reducing cost and contributing to miniaturization by contriving the layouts of various components such as flow passage internal pressure adjustment mechanisms for respective colors.

Still another advantage of some aspects of the invention is that it also provides a liquid ejecting head, a liquid ejecting apparatus, and a method of controlling the liquid ejecting head not only capable of realizing easy and effective releasing of a negative pressure by decreasing the volume of a flow passage released at the time of the releasing of the negative pressure but also capable of smoothly restoring a normal state after the releasing of the negative pressure.

Aspect 1

According to an aspect of the invention, there is provided a flow passage member used in a liquid ejecting head including an ejecting unit that ejects a liquid via a nozzle opening through driving of a driving element. The ejecting unit communicates with a negative pressure generation mechanism maintaining a negative pressure of the ejecting unit. The flow passage member includes: a flow passage internal pressure adjustment mechanism that adjusts a pressure inside a flow passage between the negative pressure generation mechanism and the ejecting unit by changing a volume of the flow passage on a way of the flow passage; and a flow passage opening and closing mechanism that opens and closes a flow passage between the negative pressure generation mechanism and the flow passage internal pressure adjustment mechanism on a way of the flow passage. The flow passage internal pressure adjustment mechanism includes a first concave portion that communicates with the flow passage opening and closing mechanism and the ejecting unit and stores a liquid, a second concave portion that communicates with a first fluid supply source, stores a fluid, and faces the first concave portion, and a first flexible member that is interposed between the first and second concave portions and seals the first and second concave portions. When the flow passage is closed by the flow passage opening and closing mechanism, the first flexible member is deformed by the fluid supplied from the first fluid supply source and a volume of a portion partitioned by the first concave portion and the first flexible member is changed to adjust the pressure inside the flow passage.

According to the aspect of the invention, the flow passage internal pressure adjustment mechanism can release the negative pressure. Since the volume of the flow passage to be released can be decreased by closing the flow passage by the flow passage opening and closing mechanism before the releasing of the negative pressure, it is possible to effectively release the negative pressure. That is, a bubble near the nozzle opening at the time of wiping is drawn to the nozzle opening by the negative pressure inside a head, the negative pressure inside the head is released at the time of the wiping in order to prevent nozzle clogging from occurring, and pressurization (releasing of the negative pressure) is performed. However, in the aspect of the invention, the flow passage on the upstream side of the flow passage from the flow passage internal pressure adjustment mechanism is closed, and then the pressurization (the releasing of the negative pressure) can be performed. Accordingly, the liquid flows backward to the upstream side extending to the negative pressure generation mechanism through the pressurization by the flow passage internal pressure adjustment mechanism, and thus it is possible to prevent the advantage of the pressurization from being reduced.

Alternatively, even when the inside of the head is pressurized by the flow passage internal pressure adjustment mechanism in order to forcibly discharge the ink from the nozzle opening, the closing of the flow passage on the upstream side of the flow passage from the flow passage internal pressure adjustment mechanism is more effective because of the above-described reason.

Here, as disclosed in JP-A-2011-161827, compared to a case in which pressurization is performed by coming into contact with the eccentric cam, a pressure reception area of the flexible member can be set to be large in the configuration in which the concave portions are sealed by the flexible member, and thus it is easy to adjust the pressure. When a tube is thickened and a change in the volume is set to be large as in JP-A-2011-161827, a flow rate is lowered and an exhaust property deteriorates as the tube is thicker.

As described in JP-A-2011-161844, when a bypass flow passage for pressurization supply is installed and the inside of the head is pressurized directly by a pressurization pump, it is difficult to minutely adjust the amount of liquid to be supplied. Therefore, there is a problem that a large amount of liquid is discharged.

An air, a liquid (oil pressure), or the like can be used as the fluid supplied by the first fluid supply source. In the case of a liquid, moisture evaporation through penetration from a flexible film can be reduced even when a barrier property of the flexible film is poor.

Aspect 2

Here, in the flow passage member according to Aspect 1, the flow passage internal pressure adjustment mechanism preferably adjusts a pressure inside the first concave portion by the air supplied from the first fluid supply source. This is because the flow passage member can be miniaturized by performing the driving by the air, and thus there is no worry of liquid leakage compared to a case in which the driving is performed by a liquid.

Aspect 3

In the flow passage member according to Aspect 1 or 2, an outlet of the liquid from the first concave portion of the flow passage internal pressure adjustment mechanism is preferably located on an upper side in a vertical direction. This is because since the outlet is located on the upper side in the vertical direction, bubbles gather on the upper side in the vertical direction due to buoyancy even when a bubble enters the first concave portion, and thus it is easy to discharge the bubble from the outlet.

Aspect 4

In the flow passage member according to Aspects 1 to 3, the flow passage internal pressure adjustment mechanism preferably further includes a first urging mechanism that urges the first flexible member from a side of the first concave portion to a side of the second concave portion. This is because a change in the pressure is suppressed during printing, and thus a pressure loss can be prevented from increasing.

Aspect 5

In the flow passage member according to Aspects 1 to 4, the liquid ejecting head preferably includes a second fluid supply source that supplies a fluid for driving the flow passage opening and closing mechanism. The flow passage opening and closing mechanism preferably opens and closes the flow passage by the fluid supplied from the second fluid supply source. This is because the driving of the flow passage opening and closing mechanism can be controlled independently from the flow passage internal pressure adjustment mechanism, and thus a series of negative pressure releasing operations can be performed smoothly and properly.

Aspect 6

In the flow passage member according to Aspects 1 to 5, the flow passage opening and closing mechanism preferably includes a third concave portion that communicates with the negative pressure generation mechanism, communicates with the flow passage internal pressure adjustment mechanism, and stores the liquid, a fourth concave portion that communicates with the second fluid supply source, stores the fluid, and faces the third concave portion, and a second flexible member that is interposed between the third and fourth concave portions and seals the third and fourth concave portions. The flow passage opening and closing mechanism preferably deforms the second flexible member by the fluid supplied from the second fluid supply source to open and close the flow passage. This is because the third and fourth concave portions are sealed by the second flexible member, the third concave portion functions as an ink chamber of a part of the flow passage, the fourth concave portion functions as an air chamber, the air can be supplied to the fourth concave portion, so that the flow passage can be opened and closed easily by deforming the second flexible member.

Aspect 7

In the flow passage member according to Aspects 1 to 6, the second flexible member preferably opens the flow passage when the fluid is not supplied from the second fluid supply source. This is because the flow passage can be opened at the time of the atmosphere opening, and a trouble such as non-supply of the ink during printing can be prevented beforehand.

Aspect 8

In the flow passage member according to Aspects 1 to 7, the flow passage opening and closing mechanism preferably further includes a second urging mechanism that urges the second flexible member from a side of the third concave portion to a side of the fourth concave portion. This is because a problem such as non-supply of the ink to the head body during printing, for example, in a state in which the flow passage is reliably opened can be prevented beforehand.

Aspect 9

In the flow passage member according to Aspects 1 to 8 the second fluid supply source preferably supplies the fluid pressurized when the flow passage is closed by the flow passage opening and closing mechanism and supplies the fluid depressurized when the flow passage is opened by the flow passage opening and closing mechanism. This is because a negative pressure releasing operation performed in cooperation with the flow passage internal pressure adjustment mechanism is performed smoothly.

Aspect 10

In the flow passage member according to Aspects 1 to 9, the negative pressure generation mechanism preferably includes a flexible member that is displaceable according to the ejection of the liquid from the ejecting unit. The flow passage opening and closing mechanism preferably closes the flow passage when the pressure inside the flow passage is adjusted by the flow passage internal pressure adjustment mechanism, so that the flexible member of the negative pressure generation mechanism is not displaced through the adjustment of the pressure by the flow passage internal pressure adjustment mechanism. This is because the pressure inside the flow passage can be adjusted effectively irrespective of compliance by the flexible member of the negative pressure generation mechanism.

Aspect 11

According to another aspect of the invention, there is provided a liquid ejecting head including an ejecting unit and the flow passage member according to Aspects 1 to 10.

According to the aspect of the invention, many excellent actions and advantages of the above-described flow passage member can be exerted on the liquid ejecting head.

Aspect 12

According to still another aspect of the invention, there is provided a liquid ejecting apparatus including a negative pressure generation mechanism and the liquid ejecting head according to Aspect 11. According to the aspect of the invention, a problem at the time of the releasing the negative pressure can be resolved.

Aspect 13

According to still another aspect of the invention, there is provided a liquid ejecting apparatus including: a liquid ejecting head that includes an ejecting unit ejecting a liquid via a nozzle opening through driving of a driving element; a negative pressure generation mechanism that communicates with the ejecting unit and maintains a negative pressure of the ejecting unit; a flow passage internal pressure adjustment mechanism that adjusts a pressure inside a flow passage between the negative pressure generation mechanism and the ejecting unit by changing a volume of the flow passage on a way of the flow passage; and a flow passage opening and closing mechanism that opens and closes a flow passage between the negative pressure generation mechanism and the flow passage internal pressure adjustment mechanism on a way of the flow passage. The negative pressure generation mechanism includes a flexible member that is displaceable according to the ejection of the liquid from the ejecting unit. The flow passage opening and closing mechanism closes the flow passage when the pressure inside the flow passage is adjusted by the flow passage internal pressure adjustment mechanism, so that the flexible member of the negative pressure generation mechanism is not displaced through the adjustment of the pressure by the flow passage internal pressure adjustment mechanism.

According to the aspect, the negative pressure can be released by the flow passage internal pressure adjustment mechanism. Since absorption of the change in the volume of the flow passage by the flow passage internal pressure adjustment mechanism by the flexible member of the negative pressure generation mechanism can be reduced by closing the flow passage by the flow passage opening and closing mechanism before the releasing of the negative pressure, it is possible to effectively perform the releasing or the pressurization of the negative pressure.

Aspect 14

In the liquid ejecting apparatus according to Aspects 1 to 13, flow passage resistance from the flow passage opening and closing mechanism to the negative pressure generation mechanism is preferably less than flow passage resistance from the flow passage opening and closing mechanism to the nozzle opening. According to the aspect of the invention, the liquid can be configured not to flow from the nozzle opening even when the flow passage is closed by the flow passage opening and closing mechanism.

Aspect 15

In the liquid ejecting apparatus according to Aspects 1 to 14, the flow passage internal pressure adjustment mechanism preferably includes a first concave portion that communicates with the flow passage opening and closing mechanism and the ejecting unit and stores a liquid, a second concave portion that communicates with a first fluid supply source, stores a fluid, and faces the first concave portion, and a first flexible member that is interposed between the first and second concave portions and seals the first and second concave portions. According to the aspect of the invention, in the configuration in which the concave portion is sealed by the flexible member, the pressure reception area of the flexible member can be set to be large, and thus it is easy to adjust the pressure.

Aspect 16

In the liquid ejecting apparatus according to Aspects 1 to 15, the flow passage internal pressure adjustment mechanism preferably further includes a first urging mechanism that urges the first flexible member from a side of the first concave portion to a side of the second concave portion. According to the aspect of the invention, it is possible to prevent the change in the pressure during printing and prevent the pressure loss from being further increased.

Aspect 17

In the liquid ejecting apparatus according to Aspects 1 to 16, the flow passage opening and closing mechanism preferably includes a third concave portion that communicates with the negative pressure generation mechanism, communicates with the flow passage internal pressure adjustment mechanism, and stores the liquid, a fourth concave portion that communicates with the second fluid supply source, stores the fluid, and faces the third concave portion, and a second flexible member that is interposed between the third and fourth concave portions and seals the third and fourth concave portions. According to the aspect of the invention, a pressure reception area of the flexible member can be set to be large in the configuration in which the concave portions are sealed by the flexible member, and thus it is easy to open and close the flow passage.

Aspect 18

In the liquid ejecting apparatus according to Aspects 1 to 17, the flow passage opening and closing mechanism preferably further includes a second urging mechanism that urges the second flexible member from a side of the third concave portion to a side of the fourth concave portion. This is because a problem such as non-supply of the ink to the head body during printing, for example, in a state in which the flow passage is reliably opened can be prevented beforehand.

Aspect 19

In the liquid ejecting apparatus according to Aspects 1 to 18, the liquid ejecting apparatus preferably further includes a suction mechanism that sucks the liquid from the nozzle opening communicating with the ejecting unit. The flow passage opening and closing mechanism preferably includes a control mechanism that sequentially performs a first mode in which the flow passage is in a closed state, a second mode in which the flow passage is switched from the closed state to an opened state, and a third mode in which the flow passage is in the opened state while the suction mechanism sucks the liquid. When the liquid is sucked from the nozzle opening by the suction mechanism, various kinds of suction can be performed by the flow passage opening and closing mechanism.

Aspect 20

In the liquid ejecting apparatus according to Aspects 1 to 19, the liquid ejecting apparatus preferably further includes a collection mechanism that collects a foreign matter in the liquid on a way of a flow passage between the flow passage internal pressure adjustment mechanism and the ejecting unit. This is because the nozzle clogging caused due to foreign matters in the ink can be removed and printing quality can be improved.

Aspect 21

According to still another aspect of the invention, there is provided a liquid ejecting head including: an ejecting unit that ejects a liquid supplied from a liquid supply source via a flow passage member via a nozzle opening through driving of a driving element; a negative pressure generation mechanism that communicates with the ejecting unit and maintains a negative pressure of the ejecting unit; a flow passage internal pressure adjustment mechanism that adjusts a pressure inside a flow passage between the negative pressure generation mechanism and the ejecting unit by changing a volume of the flow passage on a way of the flow passage; and a flow passage opening and closing mechanism that opens and closes a flow passage between the negative pressure generation mechanism and the flow passage internal pressure adjustment mechanism on a way of the flow passage. When an inside of the flow passage is pressurized by the flow passage internal pressure adjustment mechanism, the flow passage is opened by the flow passage opening and closing mechanism, and then an inside of the flow passage is depressurized by the flow passage internal pressure adjustment mechanism.

According to the aspect of the invention, a meniscus of the nozzle opening can be formed easily and properly when the liquid ejecting head is returned to a normal operation after the releasing of the negative pressure. That is, it is possible to effectively use the flow passage internal pressure adjustment mechanism.

Aspect 22

Here, in the liquid ejecting head according to Aspects 1 to 21, a volume of the flow passage internal pressure adjustment mechanism is preferably greater than a volume of the flow passage opening and closing mechanism. This is because since a volume change amount by the pressure adjustment is set to be larger with an increase in the volume, the flow passage internal pressure adjustment mechanism can be effectively used.

Aspect 23

In the liquid ejecting head according to Aspects 1 to 22, a volume of the flow passage internal pressure adjustment mechanism and a volume of the flow passage opening and closing mechanism are preferably adjusted by a displacement amount of flexible members included in the flow passage internal pressure adjustment mechanism and the flow passage opening and closing mechanism. The displacement amount of the flexible member included in the flow passage internal pressure adjustment mechanism is preferably greater than the displacement amount of the flexible member included in the flow passage opening and closing mechanism. Since the volume change amount by the pressure adjustment is set to be larger with an increase in the displacement amount of the flexible member, the flow passage internal pressure adjustment mechanism can be effectively used.

Aspect 24

In the liquid ejecting head according to Aspects 1 to 23, the negative pressure generation mechanism preferably includes a flexible member displaced by the negative pressure. The flexible member included in the negative pressure generation mechanism is preferably configured to be bent more easily than a flexible member included in the flow passage internal pressure adjustment mechanism. This is because since the change in the pressure can be absorbed by the flexible member of the negative pressure generation means at the time of the closing of the flow passage as the flexible member of the negative pressure generation mechanism is easily bent, the flow passage internal pressure adjustment mechanism may not consider the change in the pressure and the flow passage internal pressure adjustment mechanism can be effectively used.

Aspect 25

In the liquid ejecting head according to Aspects 1 to 24, the flow passage opening and closing mechanism preferably includes a third concave portion that communicates with the ejecting unit and stores the liquid, a fourth concave portion that communicates with a fluid supply source supplying a fluid for operating the flow passage opening and closing mechanism, stores the fluid, and faces the third concave portion, and a second flexible member that is interposed between the third and fourth concave portions and seals the third and fourth concave portions. A volume of the fourth concave portion is preferably less than a volume of the third concave portion.

According to the aspect of the invention, since the volume of the fourth concave portion is small, the change in the volume of the flow passage caused with the opening and the closing can be small. In particular, when the liquid is sucked in the state in which the flow passage is closed by the flow passage opening and closing mechanism installed on the supply side, the flow passage is prevented from being closed by the second flexible member in association with the negative pressure of the suction. Therefore, the inside of the third concave portion is depressurized and the second flexible member comes into contact with the third concave portion in some cases. That is, the liquid is sucked in the contact state in some cases. However, even in this case, when the volume of the fourth concave portion is small, the change in the volume of the flow passage between the depressurization inside the third concave portion and the releasing the depressurization can be small.

Aspect 26

In the liquid ejecting head according to Aspects 1 to 25, the fourth concave portion preferably includes a convex portion at a position at which the fourth concave portion comes into contact with the second flexible member. This is because since the second flexible member comes into contact with the convex portion and the position of the second flexible member can be regulated, the positions of the second flexible member of the fourth concave portion at the normal time and the depressurization time can be the same.

Aspect 27

According to still another aspect of the invention, there is provided a liquid ejecting head including: an ejecting unit that ejects a liquid supplied from a liquid supply source via a flow passage member via a nozzle opening through driving of a driving element; a flow passage internal pressure adjustment mechanism that communicates with the ejecting unit and changes a volume of a flow passage to adjust a pressure inside the flow passage; and a flow passage opening and closing mechanism that opens and closes the flow passage on a way of the flow passage between the liquid supply source and the flow passage internal pressure adjustment mechanism. A plurality of sets of the flow passage internal pressure adjustment mechanism, the flow passage opening and closing mechanism, and the ejecting units are configured. Fluids for driving the plurality of sets of flow passage internal pressure adjustment mechanisms are supplied from a common fluid supply source to the plurality of sets of flow passage internal pressure adjustment mechanisms so that the pressures inside the flow passages are respectively adjusted by all of the sets of flow passage internal pressure adjustment mechanisms.

According to the aspect of the invention, the configuration can be simplified compared to the configuration in which the fluid supply source is included for each negative pressure releasing mechanism.

Aspect 28

Here, according to Aspects 1 to 27, when the pressures inside the flow passages are respectively adjusted by all of the sets of flow passage internal pressure adjustment mechanisms, the liquids are preferably ejected from all of the sets of ejecting units by changing volumes by the flow passage internal pressure adjustment mechanisms. This is because when a volume (hereinafter also referred to as an excluded volume) necessary for the releasing of the negative pressure is different in regard to each negative pressure releasing mechanism or each head corresponding to the negative pressure releasing mechanism, the excluded volume can be reliably formed to the degree of the reliable releasing of the negative pressure in all of the negative pressure releasing mechanisms or heads while the liquid is allowed to be ejected from the negative pressure releasing mechanism or the head of which a necessary excluded volume is small, and thus the releasing of the negative pressure can be reliably performed.

Aspect 29

Here, according to Aspects 1 to 28, when the pressures inside the flow passages are respectively adjusted by all of the sets of flow passage internal pressure adjustment mechanisms, the ejecting units are preferably configured to face a cap member that caps the liquid ejecting head. When the releasing of the negative pressure is performed, the cap may be disposed below the head as countermeasures of permission of the ejection of the liquid. Thus, even when the liquid is ejected, the body or the like does not become dirty.

Aspect 30

According to still another aspect of the invention, there is provided a liquid ejecting apparatus including the liquid ejecting head according to Aspects 1 to 29.

According to the aspect of the invention, the volume of the flow passage released at the time of the releasing of the negative pressure associated with a wiping work or the like can be reduced and the negative pressure can be released easily and effectively. Restoration to a normal state after the releasing of the negative pressure can be performed smoothly.

Aspect 31

Here, in the liquid ejecting apparatus according to Aspects 1 to 30, the liquid ejecting apparatus preferably includes a control mechanism that performs control such that the flow passage is opened by the flow passage opening and closing mechanism after wiping is performed on a nozzle surface of the ejecting unit of the liquid ejecting head and an inside of the flow passage is depressurized by the flow passage internal pressure adjustment mechanism. This is because the operations correspond to return to a normal operation after the releasing of the negative pressure and predetermined operations can be sequentially performed.

Aspect 32

According to still another aspect of the invention, there is provided a liquid ejecting apparatus including: an ejecting unit that ejects a liquid supplied from a liquid supply source via a flow passage member via a nozzle opening through driving of a driving element; a first flow passage opening and closing mechanism that is installed on a way of a flow passage between the liquid supply source and the ejecting unit, and opens and closes the flow passage; a second valve (in other words, the second valve corresponds to a second flow passage opening and closing mechanism) that is installed on a way of the flow passage between the liquid supply source and the first flow passage opening and closing mechanism, and opens and closes the flow passage; and a suction mechanism that sucks the liquid inside the flow passage from the ejecting unit. An operation is performed in a first mode in which the liquid is sucked by the suction mechanism when the flow passage is opened by the first flow passage opening and closing mechanism and the flow passage is closed by the second flow passage opening and closing mechanism and is performed in a second mode in which the liquid is sucked by the suction mechanism when the flow passage is closed by the first flow passage opening and closing mechanism.

According to the aspect of the invention, the suction of each mode can be performed at a desired timing. As a result, by properly performing not only the suction at the time of initial filling but also exhaust during a printing operation after the initial filling, it is possible to reduce the unnecessary waste of the liquid associated with the suction operation as much as possible.

Aspect 33

Here, according to Aspects 1 to 32, a frequency at which the operation is performed in the second mode is preferably greater than a frequency at which the operation is performed in the first mode. This is because since a liquid consumption amount is small in the second mode, bubbles can be effectively discharged.

Aspect 34

According to Aspects 1 to 33, the operation of the second mode is preferably performed after the operation of the first mode. By performing the operations of both of the modes, it is possible to improve an exhaust property at the time of the initial filling.

Aspect 35

According to Aspects 1 to 34, in the operation of the first mode, the flow passage is preferably continuously opened by the first flow passage opening and closing mechanism. For example, when any one of atmosphere opening, depressurization, and pressurization can also be performed in the concave portion filled with the fluid of the flow passage opening and closing mechanism and the depressurization is performed at the time of the suction of the ejecting unit, it is possible to prevent the elastic member from being drawn due to the suction from the ejecting unit and unintentionally closing the flow passage.

Aspect 36

According to still another aspect of the invention, there is provided a method of controlling a liquid ejecting head including an ejecting unit that ejects a liquid supplied from a liquid supply source via a flow passage member via a nozzle opening through driving of a driving element, a negative pressure generation mechanism that communicates with the ejecting unit and maintains a negative pressure of the ejecting unit, a flow passage internal pressure adjustment mechanism that adjusts a pressure inside a flow passage between the negative pressure generation mechanism and the ejecting unit by changing a volume of the flow passage on a way of the flow passage, and a flow passage opening and closing mechanism that opens and closes a flow passage between the negative pressure generation mechanism and the flow passage internal pressure adjustment mechanism on a way of the flow passage. The method includes: pressurizing an inside of the flow passage by the flow passage internal pressure adjustment mechanism; and opening the flow passage by the flow passage opening and closing mechanism, and then depressurizing an inside of the flow passage by the flow passage internal pressure adjustment mechanism when the inside of the flow passage is pressurized by the flow passage internal pressure adjustment mechanism.

According to the aspect of the invention, the operations correspond to return to the normal operation of the liquid ejecting head after the releasing of the negative pressure, and a meniscus of the nozzle opening can be formed easily and properly.

Aspect 37

According to still another aspect of the invention, there is provided a liquid ejecting head including an ejecting unit that ejects a liquid via a nozzle opening through driving of a driving element, communicating with liquid storage units respectively storing a plurality of kinds of liquids via flow passage members, and ejecting the liquid from the ejecting unit as a liquid droplet. The liquid ejecting head includes: a plurality of negative pressure generation mechanisms that include a third flexible member displaceable according to the ejection of the liquid from the ejecting unit and maintains a negative pressure of the ejecting unit for each of the plurality of kinds of liquids; and a flow passage opening and closing mechanism that opens and closes a flow passage for each of the kinds of liquids. The flow passage opening and closing mechanism includes a second flexible member that is displaceable according to an amount of fluid supplied from a fluid supply source and a third concave portion that seals the second flexible member and is formed for each of the kinds of liquids on a way of a flow passage between the negative pressure generation mechanism and the ejecting unit. A flow passage formed between the third concave portion and the second flexible member is opened and closed through the displacement of the second flexible member, a displacement direction of the second flexible member intersects a displacement direction of the third flexible member, and the plurality of third concave portions are arranged between the plurality of negative pressure generation mechanisms when viewed in the displacement direction of the second flexible member.

According to the aspect of the invention, the dimensions of the negative pressure generation mechanism for which it is necessary to ensure a relatively large pressure reception area are increased in a surface direction perpendicular to the displacement direction of the third flexible member, but the plurality of negative pressure generation mechanisms can be lined in so-called vertical disposition. Therefore, it is possible to miniaturize the dimensions in the surface direction, compared to the case in which the negative pressure generation mechanisms are lined in the surface direction. Further, since the flow passage opening and closing mechanism is disposed between the plurality of negative pressure generation mechanisms arranged in the so-called vertical disposition, the flow passage member can be miniaturized.

Here, the second flexible member may be disposed at different heights or may be disposed on the same plane for each kind of liquid. The space between the plurality of negative pressure generation means refers to a space the inside of one negative pressure generation mechanism and the inside of the opposite negative pressure generation mechanism.

Aspect 38

Here, in the liquid ejecting head according to Aspects 1 to 37, the liquid ejecting head preferably further includes a flow passage internal pressure adjustment mechanism. The flow passage internal pressure adjustment mechanism preferably includes a first flexible member that is displaceable according to an amount of a fluid supplied from a fluid supply source and a first concave portion that is sealed by the first flexible member and is formed for each kind of liquid on a way of a flow passage between the negative pressure generation mechanism and the flow passage internal pressure adjustment mechanism. A volume of a flow passage formed by the first concave portion and the first flexible member is preferably changed through the displacement of the first flexible member to adjust a pressure inside the flow passage formed by the first concave portion and the first flexible member. The third concave portion and the first concave portion for each kind of liquid are preferably configured to overlap at least partially when viewed in a displacement direction of the second flexible member. Since the positional relation between the flow passage opening and closing mechanism and the flow passage internal pressure adjustment mechanism is set such that flow passage opening and closing mechanism and the flow passage internal pressure adjustment mechanism overlap at least partially, it is possible to miniaturize an installation area to the extent of the overlapping.

Aspect 39

In the liquid ejecting head according to Aspects 1 to 38, a flow passage from the negative pressure generation mechanism and a flow passage from the flow passage internal pressure adjustment mechanism are preferably configured to overlap at least partially in the displacement direction of the second flexible member. This is because miniaturization in the lamination direction can be realized when the flow passage from the negative pressure generation mechanism to the flow passage opening and closing mechanism and the flow passage from the flow passage internal pressure adjustment mechanism overlap at least partially in the lamination direction which is the displacement direction of the second flexible member. Further, since the flow passages are formed so that the flow passage substrates overlap, the dimensions in the lamination direction can be reduced.

Aspect 40

In the liquid ejecting head according to Aspects 1 to 39, a volume of the first concave portion sealed by the first flexible member is preferably set to be greater than a volume of the third concave portion sealed by the second flexible member. This is because since a volume change amount by the adjustment of the pressure can be increased with an increase in the volume of the first concave portion, for example, the pressurization can be effectively performed even when the number of nozzles increases, and thus the degree of freedom of the flow passage internal pressure adjustment mechanism is improved. As the volume of the third concave portion of the flow passage opening and closing mechanism is smaller, a space necessary for the installation area or the like can be reduced, which contributes to the miniaturization of the liquid ejecting head. Here, the volume refers to a volume when the second and first flexible members are not displaced.

Aspect 41

In the liquid ejecting head according to Aspects 1 to 40, a displacement amount of the first flexible member is preferably greater than a displacement amount of the second flexible member. Since the volume change amount by the adjustment of the pressure can be increased with the increase in the displacement amount of the first flexible member, the flow passage internal pressure adjustment mechanism can be effectively used. Here, the displacement amount of the second flexible member refers to a displacement amount (stroke amount) between an atmosphere opened state and a flow passage closed state. The displacement amount of the first flexible member refers a displacement amount (stroke amount) between the atmosphere opened state and a state in which the first flexible member comes into contact with the wall surface of the facing first concave portion as the result of the pressurization.

Aspect 42

In the liquid ejecting head according to Aspects 1 to 41, the third flexible member is preferably configured to be bent more easily than the first flexible member. This is because as the third flexible member of the negative pressure generation mechanism is easily bent, the change in the pressure at the time of the closing of the flow passage can be absorbed by the third flexible member of the negative pressure generation mechanism, and therefore the flow passage internal pressure adjustment mechanism may not consider the change of the pressure and the flow passage internal pressure adjustment mechanism can be effectively used.

Aspect 43

In the liquid ejecting head according to Aspects 1 to 42, the first flexible member is preferably urged from the first concave portion to the first flexible member. This is because since the first flexible member is urged, casual displacement during printing can be prevented.

Aspect 44

In the liquid ejecting head according to Aspects 1 to 43, the first flexible member is preferably formed to be able to come into contact with a wall surface of the first concave portion facing the second flexible member through urging. This is because the displacement during printing can be prevented when the second flexible member comes into contact with the wall surface of the first concave portion.

Aspect 45

In the liquid ejecting head according to Aspects 1 to 44, the first flexible member is preferably formed to be able to come into contact with a wall surface facing the first flexible member in the wall surface of the first concave portion through displacement. This is because the first flexible member can be pressurized at a target value and the displacement amount can be adjusted.

Aspect 46

According to still another aspect of the invention, there is provided a liquid ejecting apparatus including a negative pressure generation mechanism and the liquid ejecting head according to Aspects 1 to 45.

According to the aspect of the invention, the liquid ejecting apparatus can be miniaturized since the small and cheap liquid ejecting head is mounted.

Aspect 47

According to still another aspect of the invention, there is provided a flow passage member used in a liquid ejecting head including an ejecting unit that ejects a liquid via a nozzle opening through driving of a driving element and communicating with liquid storage units respectively storing a plurality of kinds of liquids. The flow passage member includes: a first flow passage substrate in which first concave portions disposed on ways of flow passages communicating with the liquid storage units and the ejecting unit and formed for the respective kinds of liquids are integrated; and a flow passage internal pressure adjustment mechanism that includes the first concave portions and first flexible members respectively sealing the first concave portions and adjusts a pressure inside a flow passage formed by the first concave portion and the first flexible member by displacing the first flexible member through an increase and a decrease in an amount of fluid supplied from a first fluid supply source and changing a volume of the flow passage.

According to the aspect of the invention, components can be shared between the colors. That is, the components can be shared between the colors by the single first flow passage substrate in which the first concave portion for each color is formed or the flow passage internal pressure adjustment mechanism including the first concave portion and the first flexible member.

Compared to the case in which the pressurization is performed through the contact of the eccentric cam as in JP-A-2011-161827, a displacement area of the first flexible member can be set to be large in the configuration in which the first concave portion is sealed by the first flexible member. Thus, it is possible to achieve a structure in which the miniaturization is realized and the change in the volume can be easily made. Since the volume of the first concave portion is adjusted by the fluid supplied from the first fluid supply source, the miniaturization can also be realized.

An air, a liquid (oil pressure), or the like can be used as the fluid supplied by the first fluid supply source. Thus, in the case of a liquid, moisture evaporation through penetration from a first flexible member can be reduced even when a barrier property of the first flexible member is poor.

Aspect 48

Here, the flow passage member according to Aspects 1 to 47 preferably further includes a second flow passage substrate in which second concave portions are formed. The first flexible member is preferably configured to be sealed between the first and second concave portions disposed to face each other. This is because, for example, a fluid such as an air supplied from the first fluid supply source can be prevented to being stuck to the first flexible member by configuring the concave portions compared to a case in which the concave portions are flat, and the components can be shared between the colors in the second flow passage substrate in which the second concave portions are formed.

Aspect 49

In the flow passage member according to Aspects 1 to 48, the second concave portion is preferably present for each kind of liquid and the plurality of second concave portions are preferably integrated in the second flow passage substrate. This is because the volume of the fluid supplied by the first fluid supply source can be decreased. As a result, since the second concave portion can be formed for each kind of liquid, the volume of the second concave portion can be decreased, and thus a sufficient pressurization effect to the first flexible member can be obtained.

Aspect 50

In the flow passage member according to Aspects 1 to 49, an outlet of the liquid from the first concave portion is preferably located on an upper side in a vertical direction. This is because since the outlet is located on the upper side in the vertical direction, a bubble stays on the upper side in the vertical direction due to buoyancy even when the bubble enters the first concave portion, and therefore the bubble is easily discharged from the outlet.

Aspect 51

The flow passage member according to Aspects 1 to 50 preferably further includes a third flow passage substrate in which third concave portions disposed on ways of flow passages communicating with the liquid storage unit and the first concave portions and formed for the respective kinds of liquids are integrated; second flexible members that seal the plurality of third concave portions, respectively; and a flow passage opening and closing mechanism that opens and closes flow passages inside the third concave portions by displacing the second flexible members through an increase or a decrease of an amount of fluid supplied from a second fluid supply source.

Aspect 52

In the flow passage member according to Aspects 1 to 51, the flow passage member preferably further includes a fourth flow passage substrate in which fourth concave portions are formed. The second flexible member is preferably configured to be sealed between the third and fourth concave portions disposed to face each other. This is because the fluid supplied from the second fluid supply source can be prevented from being stuck to the second flexible member by configuring the concave portions compared to a case in which the concave portion is flat, and the components can also be shared between the plurality of colors in the fourth flow passage substrate.

Aspect 53

In the flow passage member according to Aspects 1 to 52, the fourth concave portion is preferably present for each kind of liquid and the plurality of fourth concave portions are integrated in the fourth flow passage substrate. This is because the volume on the side on which the driving fluid for displacing the second flexible member is supplied can be decreased.

Aspect 54

In the flow passage member according to Aspects 1 to 53, the first flow passage substrate and the third flow passage substrate are preferably the same member. This is because the number of components can be reduced.

Aspect 55

In the flow passage member according to Aspects 1 to 54, the first flow passage substrate and the third flow passage substrate are preferably different members and are laminated so that a surface in which the first concave portions are not formed between both surfaces of the first flow passage substrate faces a surface in which the third concave portions are not formed between both surfaces of the third flow passage substrate. Since the flow passage substrates are laminated in order of the driving fluid for the second flexible member→the liquid to be ejected→the liquid to be ejected→the driving fluid for the first flexible member, the flow passage between the first and third concave portions can be shortened compared to cases of other lamination orders. Further, this is because the installation area of each component can be reduced by laminating the flow passage substrates.

Aspect 56

In the flow passage member according to Aspects 1 to 55, at least some of the first concave portions and the third concave portions preferably overlap in a lamination direction for the respective kinds of liquids. This is because the installation area can be smaller because of the lamination structure.

Aspect 57

In the flow passage member according to Aspects 1 to 56, a volume of the first concave portion sealed by the first flexible member is preferably greater than a volume of the third concave portion sealed by the second flexible member. Since the volume change amount by the adjustment of the pressure can be increased with an increase in the volume of the first concave portion, the degree of freedom of the flow passage internal pressure adjustment mechanism is improved. That is, this is because the pressurization can be effectively performed even when the number of nozzles is increased. As the volume of the flow passage opening and closing mechanism is smaller, a space necessary for the installation area or the like can be reduced, which contributes to the miniaturization. The volume mentioned here refers to a volume when the flexible member is not displaced.

Aspect 58

In the flow passage member according to Aspects 1 to 57, a displacement amount of the first flexible member is preferably greater than a displacement amount of the second flexible member. Since the volume change amount by the adjustment of the pressure can be increased with the increase in the displacement amount of the first flexible member, the flow passage internal pressure adjustment mechanism can be effectively used. Here, the displacement amount of the first flexible member refers to a displacement amount (stroke amount) between an atmosphere opened state and a flow passage closed state. The displacement amount of the second flexible member refers a displacement amount (stroke amount) between the atmosphere opened state and a pressurized state, that is, a state in which the second flexible member comes into contact with the facing wall surface as the result of the pressurization.

Aspect 59

According to still another aspect of the invention, there is provided a liquid ejecting head including an ejecting unit and the flow passage member according to Aspects 1 to 58.

According to the aspect of the invention, the miniaturization and low cost of the liquid ejecting head can be achieved with the miniaturization and low cost of the flow passage member.

Aspect 60

Here, in liquid ejecting head according to Aspects 1 to 59, the liquid ejecting head preferably further includes a negative pressure generation mechanism that maintains a negative pressure of the ejecting unit. The negative pressure generation mechanism preferably includes a flexible member which is displaceable according to the ejection of the liquid from the ejecting unit and is displaced in a direction intersecting a direction in which a plurality of the flow passage internal pressure adjustment mechanisms are disposed in a single flow passage substrate. This is because since the displacement direction of the flexible member of the negative pressure generation mechanism is a direction intersecting the disposition direction of the flow passage internal pressure adjustment mechanism in the single flow passage substrate, the entire space occupied by the negative pressure generation mechanism and the flow passage member can be reduced.

Aspect 61

According to still another aspect of the invention, there is provided a liquid ejecting apparatus including the liquid ejecting head according to Aspects 1 to 60.

According to the aspect of the invention, it is possible to provide the miniaturized and low-cost liquid ejecting apparatus.

In combinations of at least two aspects of Aspects 1 to 61, each of each of the liquid ejecting head, the liquid ejecting apparatus, the flow passage member, and the method of controlling the liquid ejecting head may be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail with reference to the drawings.

A: Liquid Ejecting Apparatus

A liquid ejecting apparatus according to the embodiment is an ink jet recording apparatus and includes an ink jet recording head as a liquid ejecting head. The liquid ejecting apparatus is a so-called line type recording apparatus that performs printing by transporting a recording sheet such as a sheet which is a medium to which a liquid is ejected without movement of a liquid ejecting head.

Figure 1:
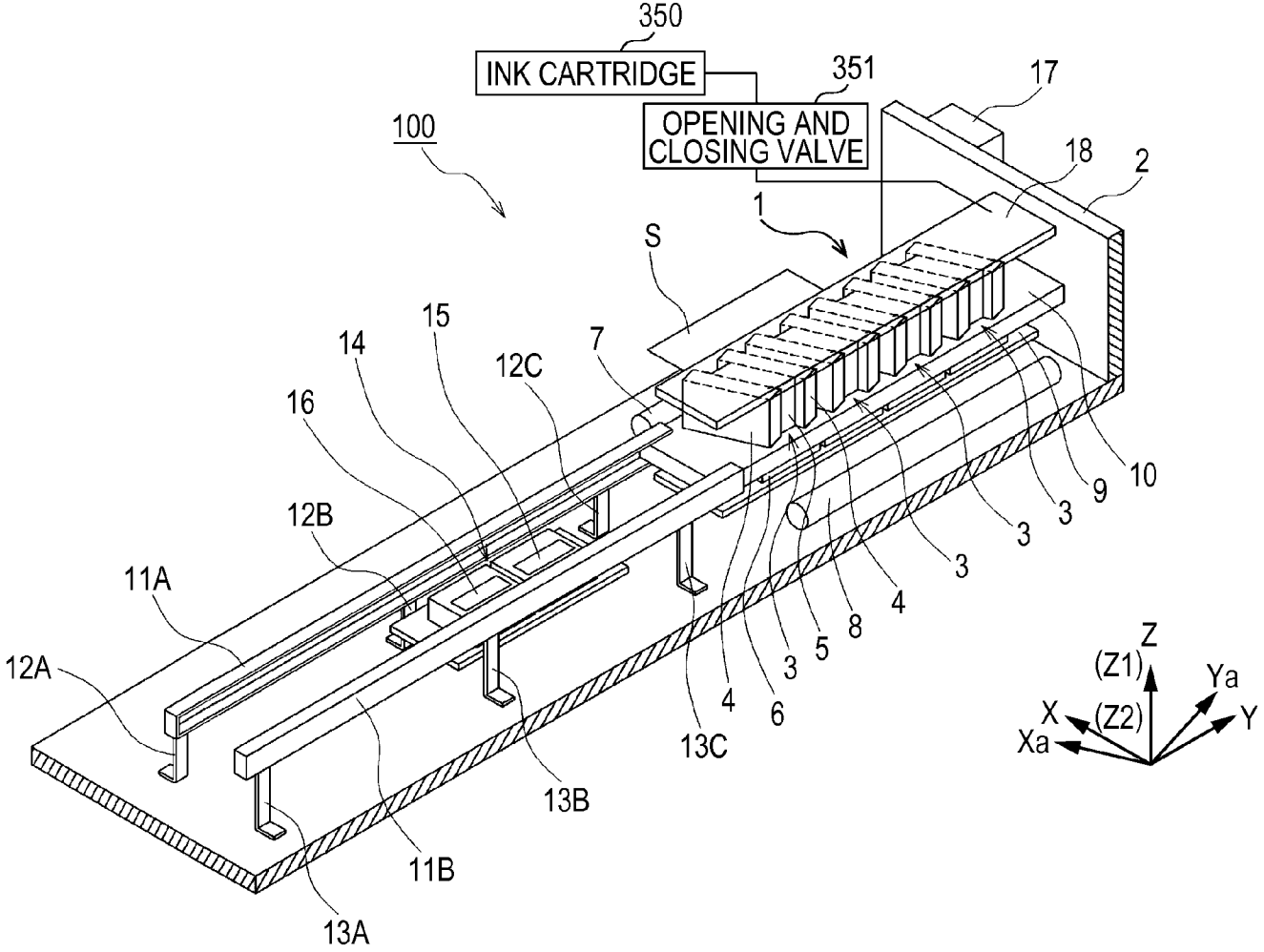
FIG. 1 is a schematic perspective view illustrating a recording apparatus according to an embodiment of the invention.

Specifically, as illustrated in FIG. 1 (which is a schematic perspective view illustrating a recording apparatus according to the embodiment), an ink jet recording apparatus 100 (hereinafter also referred to as a recording apparatus 100) includes an ink jet recording head unit 1 (hereinafter also referred to as a liquid ejecting head unit 1) that is disposed in an apparatus body 2; an ink cartridge 350 that is an ink supply source storing ink to be supplied to the liquid ejecting head unit 1; an opening and closing valve 351 that is a flow passage opening and closing mechanism opening and closing a flow passage between the ink cartridge 350 and the liquid ejecting head unit 1; a transport mechanism that transports a recording sheet S which is a recording medium such as a sheet; a support member 9 that supports the rear surface side opposite to a printing surface of the recording sheet S; a pair of rails 11A and 11B that are fixed to a floor surface of the apparatus body 2; a cleaning mechanism 14 that is disposed on the floor surface of the apparatus body 2; and a control device 17 that controls an operation of each unit of the recording apparatus 100. These constituents will be described in detail below.

In the embodiment, a transport direction of the recording sheet S is referred to as a first direction X. In in-plane direction in which nozzle openings of a liquid ejecting head 3 are opened, a direction perpendicular to the first direction X is referred to as a second direction Y. A direction perpendicular to the first direction X and the second direction Y is referred to as a third direction Z. For the third direction Z, the side of the liquid ejecting head 3 with respect to the recording sheet S is referred to as a Z1 side and its opposite side is referred to as a Z2 side.

(A-1-1) Liquid Ejecting Head Unit

The liquid ejecting head unit 1 according to the embodiment is a collective of the liquid ejecting heads 3 in which a plurality of ink jet recording heads 3 (hereinafter also referred to as liquid ejecting heads 3) are arranged in parallel on a base plate 10.

(A-1-2) Liquid Ejecting Head

The liquid ejecting heads 3 according to the embodiment are formed as single units to correspond four colors of CMYK by combining the self-sealing units 4,4 which are respectively supplied with ink of two colors and flow passage members 5 in which four kinds of flow passages are formed to correspond to respective colors, with head bodies 6. In the embodiment, four liquid ejecting heads 3 are arranged in parallel in the second direction Y on the base plate 10. That is, the liquid ejecting head 3 includes two self-sealing units 4,4 which are a negative pressure generation mechanism, the flow passage member 5 which is interposed between the self-sealing units 4,4 from both sides and supplies the ink supplied from the self-sealing units 4,4 to the head body 6, and the head body 6 which ejects the ink supplied via the flow passage member 5 as ink droplets to the printing surface of the recording sheet S.

In the embodiment, the liquid ejecting heads 3 are disposed on the base plate 10 by tilting the liquid ejecting heads 3 in the first direction X. Thus, a direction in which the liquid ejecting heads 3 are disposed by tilting the liquid ejecting heads 3 in the first direction X is referred to as a fourth direction Xa and a direction in which the liquid ejecting heads 3 are tilted at the same degrees in the second direction Y to be perpendicular to the fourth direction Xa is referred to as a fifth direction Ya. Both directions are directions on the X-Y plane.

(A-1-2-1) Head Body

As will be described in detail below, the head body 6 includes an ejecting unit 6A (see FIG. 5: the same applies below) in which a liquid flow passage including a plurality of pressure generation chambers communicating with nozzles are formed and which includes a pressure generation mechanism configured by piezoelectric elements or the like causing a change in pressure to be generated in the ink in the pressure generation chambers; and a filter mechanism 6B (see FIG. 5: the same applies below) which removes foreign matters of the ink to be supplied to the ejecting unit 6A. In the head body 6, the base plate 10 is disposed to protrude downward from the bottom surface of the base plate 10.

(A-1-2-2) Self-Sealing Unit

As will be described in detail below, the self-sealing unit 4 includes a liquid flow passage in which an opening of a concave portion formed in a side surface intersecting a nozzle formation surface of the head body 6 is sealed with a film which is a third flexible member. A valve body is disposed halfway in the liquid flow passage and is configured such that the valve body is urged to close the liquid flow passage at a normal time and the valve body pressurized by the film displaced by a negative pressure of the pressure generation chamber opens the liquid flow passage when the negative pressure becomes equal to or greater than a predetermined value with ejection of the ink. Thus, when a negative pressure equal to or greater than a predetermined value is generated in the ejecting unit 6A of the head body 6 with ejection of the ink, the film presses the valve body, the valve body is opened due to the pressurization pressure, the ink flows to the liquid flow passage, and the ink is supplied to the head body 6.

(A-1-2-3) Distribution Unit

The distribution unit 18 is placed on the top surface of the liquid ejecting head 3 of each unit and extends in the second direction Y. The distribution unit 18 distributes the ink of each color from the ink cartridge 350 to each of the self-sealing units 4 of the liquid ejecting head 3 of each unit and distributes a driving control air of the flow passage internal pressure adjustment mechanism (not illustrated in FIG. 1) and the flow passage opening and closing mechanism (not illustrated in FIG. 1) of the flow passage member 5 to the flow passage member 5. Here, the dimension (height) of the self-sealing unit 4 in the third direction and the dimension (height) of the flow passage member 5 in the third direction are configured to be identical to each other. As a result, it is easy to install the distribution unit 18 functioning as a distribution flow passage of the ink and the air in the liquid ejecting head 3 of each unit. More specifically, the self-sealing unit 4 and the flow passage member 5 are connected to the common distribution unit 18 and this connection is realized by inserting bulges (concave needles) formed on the bottom surface of the distribution unit 18 into holes (convex insertion holes) formed on the top surfaces of the self-sealing unit 4 and the flow passage member 5 which are the negative pressure generation mechanism. In the distribution unit 18, a flow passage having a distribution function for the liquid ejecting head 3 of each unit is formed by forming a groove on the planar substrate in the second direction Y and sealing the groove with a film. Thus, the top surfaces of the self-sealing units 4 and the flow passage members 5 are arranged in the height direction which is the third direction Z in order to align with the groove formed along the plane the distribution unit 18. The lengths of the bulges of the distribution unit 18 are classified into long and short lengths in order to prevent drag from being applied simultaneously with respect to all of the bulges when the bulges of the distribution unit 18 are inserted into the holes of the top surfaces of the self-sealing units 4 and the flow passage members 5.

(A-1-2-4) Flow Passage Member

As will be described in detail below, the flow passage member 5 is formed by laminated flow passage substrates 101, 102, 103, 104, and 105, a first flexible member 160, and a second flexible member 164 and functions as a flow passage internal pressure adjustment mechanism 161 and a flow passage opening and closing mechanism 165.

The flow passage internal pressure adjustment mechanism 161 adjusts a pressure inside the liquid flow passage by changing the volume of the liquid flow passage on the way of the liquid flow passage between the self-sealing unit 4 and the head body 6.

The flow passage opening and closing mechanism 165 opens and closes the liquid flow passage on the way of the liquid flow passage between the self-sealing unit 4 and the flow passage internal pressure adjustment mechanism 161.

(A-2) Transport Mechanism

The transport mechanism relatively moves the recording sheet S with respect to the liquid ejecting head 3 in the first direction. The transport mechanism includes, for example, a first transport roller 7 and a second transport roller 8 installed on both sides of the liquid ejecting heads 3 in the first direction X which is the transport direction of the recording sheet S. The transport mechanism transports the recording sheet S on the upstream side and the downstream side of the liquid ejecting head unit 1 in the first direction X by the first transport roller 7 and the second transport roller 8. The transport mechanism transporting the recording sheet S is not limited to the transport rollers 7 and 8, but may be a belt, a drum, or the like.

(A-3) Support Member

The support member 9 supports the recording sheet S at a position facing the liquid ejecting head unit 1. In the support member 9, for example, a metal or a resin having a cross-sectional surface with a rectangular shape and installed to face the liquid ejecting head 3, particularly, a nozzle surface of the head body 6, is installed between the first transport roller 7 and the second transport roller 8. The support member 9 supports the recording sheet S transported by the first transport roller 7 and the second transport roller 8 at the position facing the liquid ejecting head unit 1.

The support member 9 may include an adsorption mechanism that adsorbs the transported recording sheet S on the support member 9. Examples of the adsorption mechanism include a mechanism that sucks and adsorbs the recording sheet S and a mechanism that electrostatically adsorbs the recording sheet S through an electrostatic force.

In the recording apparatus 100, the recording sheet S is transported by the first transport roller 7 and printing is performed on the recording sheet S supported on the support member 9 by each of the liquid ejecting heads 3. The printed recording sheet S is transported by the second transport roller 8.

(A-4) Pair of Rails

One pair of rails 11A and 11B extend in the second direction Y and are fixed to the floor surface of the apparatus body 2 via support members 12A, 12B, and 12C and support members 13A, 13B, ad 13C. The cross-sectional surfaces of the rails 11A and 11B are rod-shaped members having cross-sectional surfaces with C type reception portions. Both ends of the base plate 10 in the first direction X are inserted into the reception portions. Thus, the base plate 10 can be supported between the rails 11A and 11B to move in the second direction Y. As a result, the liquid ejecting head unit 1 can move along the rails 11A and 11B in the second direction in a state in which the liquid ejecting head unit 1 is disposed on the base plate 10. That is, the liquid ejecting head unit 1 moves from a base end side which is one end side of the rails 11A and 11B in the second direction Y to a distal end side which is the other end side and also moves toward the opposite side.

(A-5) Cleaning Mechanism

The cleaning mechanism 14 cleaning the nozzle surface (not illustrated) of the head body 6 is disposed in a halfway portion of the rails 11A and 11B and the floor surface of the apparatus body 2 between the rails 11A and 11B. The cleaning mechanism 14 according to the embodiment includes a wiping mechanism 15 and a suction mechanism 16.

The wiping mechanism 15 includes a wiping blade wiping the nozzle surface which is a liquid droplet ejection surface and moves in the second direction Y of the liquid ejecting head unit 1 at a predetermined timing and slides the distal end of the wiping blade to the nozzle surface to perform a wiping operation of wiping out the nozzle surface.

The suction mechanism 16 is disposed on the floor surface of the apparatus body 2 to be adjacent to the wiping mechanism 15 in the second direction Y and performs a suction operation of covering the nozzle surface with a cam member with movement of the liquid ejecting head unit 1 in the second direction Y at a predetermined timing and sucking the inside of the cam member through action of a negative pressure to forcibly discharge the ink or the like from the nozzle openings. Here, the head body 6 performing the wiping and the suction is located above the wiping mechanism 15 and the suction mechanism 16 in the third direction Z sequentially with movement of the base plate 10 in the Y direction so that a predetermined work is performed.

(A-6) Control Device

The control device 17 controls an operation of each unit of the recording apparatus 100. The control device 17 performs control for a cleaning operation at a predetermined timing with the movement of the base plate 10 to a predetermined position along with ejection control of the ink droplets in the liquid ejecting head 3 and transport control of the recording sheet S. The control device 17 also performs opening and closing control of the opening and closing valve 351 and driving control of the flow passage internal pressure adjustment mechanism 161 and the flow passage opening and closing mechanism 165 through the air.

B: Liquid Ejecting Head

Figure 2:
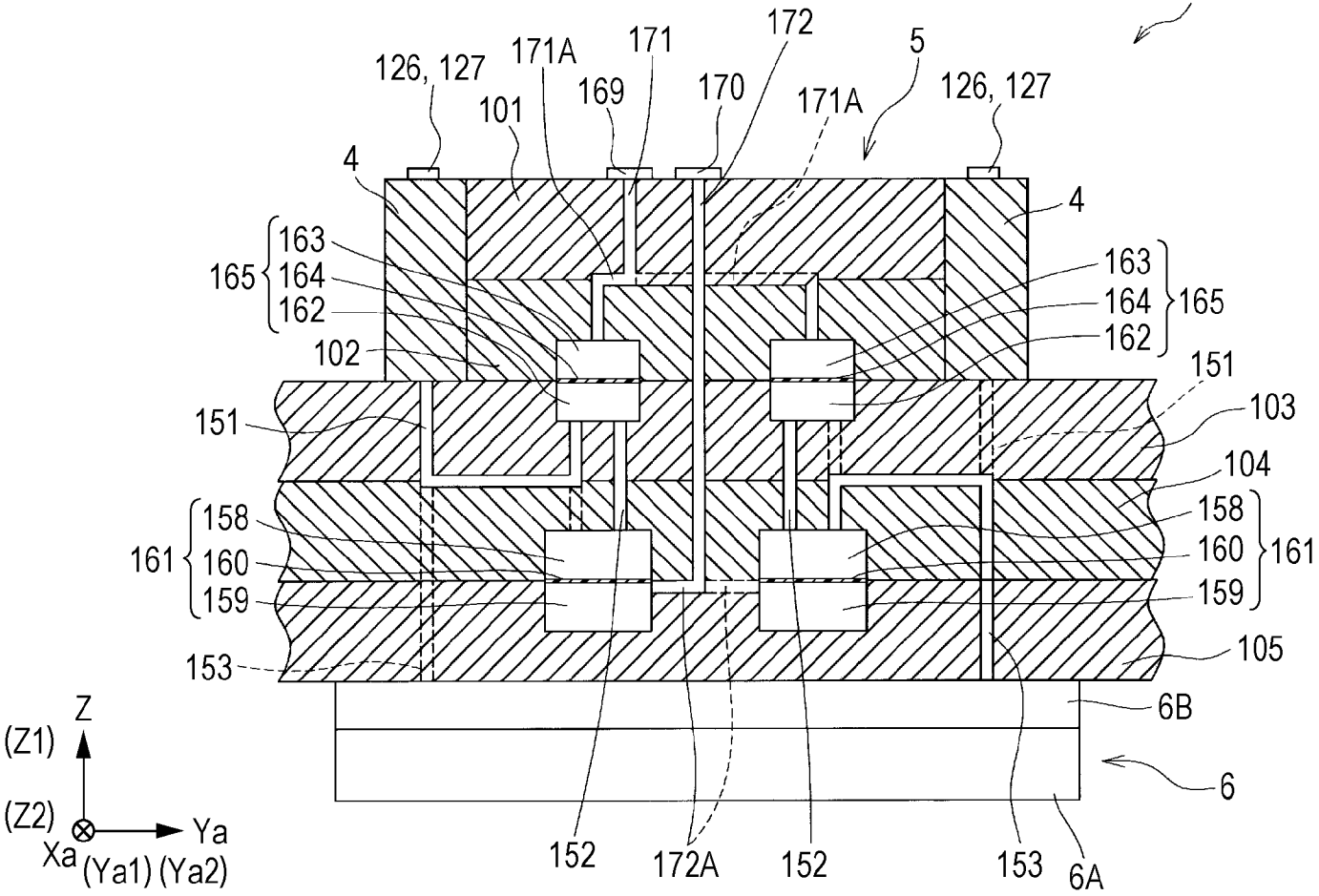
FIG. 2 is a schematic sectional view illustrating a liquid ejecting head according to the embodiment of the invention.

FIG. 2 is a schematic sectional view schematically illustrating the liquid ejecting head according to the embodiment of the invention. As illustrated in the drawing, the liquid ejecting head 3 according to the embodiment includes the two self-sealing units 4,4 which are the negative pressure generation mechanism, the flow passage member 5, and the head body 6. The self-sealing units 4,4 are disposed on both sides of the flow passage member 5 in the fifth direction Ya. The self-sealing units 4,4 are supplied with the ink four colors of CMYK via two ink supply openings 126 (127), respectively, as will be described in detail below. In FIG. 2, the ink supply openings 127 are superimposed with the ink supply openings 126, and thus are not illustrated. The ink supply opening 126 (127) is supplied with one color of CMYK by an ink storage mechanism such as an ink cartridge.

(B-1-1) Structure of Flow Passage Internal Pressure Adjustment Mechanism

The flow passage member 5 is formed such that five flow passage substrates 101, 102, 103, 104, and 105 are laminated. Here, first concave portions 158 are formed on a surface (hereinafter referred to as a bottom surface) of the flow passage substrate 104 on the Z2 side in the third direction Z and second concave portion 159 facing the first concave portions 158 are formed on a surface (hereinafter referred to as a top surface) of the flow passage substrate 105 on the Z1 side. A first flexible member 160 formed of, for example, a rubber is interposed between the first concave portion 158 and the second concave portion 159. As a result, the first concave portion 158 and the second concave portion 159 serve as two chambers sealed by the first flexible member 160. Thus, the volume of the first concave portion 158 can be adjusted according to a displacement amount of the first flexible member 160 in the third direction Z. An air flow passage 172 opened to the top surface of the flow passage substrate 101 is penetrated through the flow passage substrates 101, 102, 103, and 104 to reach the top surface of the flow passage substrate 105. A horizontal flow passage 172A communicating with the second concave portion 159 is formed on the top surface of the flow passage substrate 105, and thus an air flow passage 172 extending from an air supply opening 170 formed on the top surface of the flow passage substrate 101 to the second concave portion 159 communicates. Thus, the displacement amount of the first flexible member 160 can be adjusted by adjusting the amount of air supplied from an air supply source (not illustrated) which is a first fluid supply source which supplies a fluid for driving the flow passage internal pressure adjustment mechanism 161 via the air supply opening 170. As will be described below, the first concave portion 158 communicates with an ink flow passage. That is, the flow passage internal pressure adjustment mechanism 161 is formed which adjusts the pressure inside the ink flow passage by changing the volume of the ink flow passage with the first concave portion 158, the second concave portion 159, and the first flexible member 160. Here, although not illustrated, a spring giving an urging force directed from the first concave portion 158 to the second concave portion 159 is disposed in the first concave portion 158.

The remaining three first concave portions 158 and second concave portions 159 having the same configurations are formed in the bottom surfaces of the flow passage substrates 104 and the top surfaces of the flow passage substrates 105, and the first flexible members 160 are interposed between the first concave portions 158 and the second concave portions 159. That is, a total of four flow passage internal pressure adjustment mechanisms 161 corresponding to the respective colors of CMYK are distributed and disposed on the Xa-Ya planes formed on the bottom surfaces of the flow passage substrates 104 and the top surfaces of the flow passage substrates 105. An air is supplied to each second concave portion 159 via the horizontal flow passage 172A branched in the horizontal direction at the lower end of the air flow passage 172, in addition to the three remaining second concave portions 159, so that the same function is realized. The first concave portion 158 communicates with the ink flow passage, the second concave portion 159 communicates with the air flow passage, and the first flexible member 160 seals the first concave portion 158 and the second concave portion 159. Therefore, in the following description, the first concave portion 158 serving as an ink chamber is referred to as the first concave portion (ink chamber) 158 and the second concave portion 159 serving as an air chamber is referred to as the second concave portion (air chamber) 159.

(B-1-2) Structure of Flow Passage Opening and Closing Mechanism

On the other hand, a third concave portion 162 is formed on the top surface of the flow passage substrate 103 and a fourth concave portion 163 facing the third concave portion 162 is formed on the bottom surface of the flow passage substrate 102. A second flexible member 164 formed of, for example, a rubber is interposed between the third concave portion 162 and the fourth concave portion 163. As a result, the third concave portion 162 and the fourth concave portion 163 serve as two chambers sealed by the second flexible member 164. Thus, a flow passage can be closed or opened through displacement of the second flexible member 164 in the third direction Z. An air flow passage 171 opened to the top surface of the flow passage substrate 101 is penetrated through the flow passage substrate 101 to reach the top surface of the flow passage substrate 102. A horizontal flow passage 171A is formed on the top surface of the flow passage substrate 102 and the air flow passage 171 communicates with the fourth concave portion 163 through the horizontal flow passage 171A. Thus, the air flow passage 171 extending from an air supply opening 169 formed on the top surface of the flow passage substrate 101 to the fourth concave portion 163 communicates. Thus, the flow passage is opened and closed by supplying an air from the air supply source (not illustrated) which is a second fluid supply source supplying a fluid for driving the flow passage opening and closing mechanism 165 via the air supply opening 169 and displacing the second flexible member 164. As will be described below, the first concave portion 158 communicates with the ink flow passage. That is, the flow passage opening and closing mechanism 165 opening and closing the ink flow passage are formed with the third concave portion 162, the fourth concave portion 163, and the second flexible member 164.

The remaining three third concave portions 162 and fourth concave portions 163 having the same configurations are formed in the top surfaces of the flow passage substrates 103 and the bottom surfaces of the flow passage substrates 102, and the second flexible members 164 are interposed between the third concave portions 162 and the fourth concave portions 163. That is, a total of four flow passage opening and closing mechanism 165 corresponding to the respective colors of CMYK are distributed and disposed in the middle portions of the Xa-Ya planes formed on the top surfaces of the flow passage substrates 103 and the bottom surfaces of the flow passage substrates 102. An air is supplied to each fourth concave portion 163 via the horizontal flow passage 171A formed between the bottom surface of the flow passage substrate 101 and the top surface of the flow passage substrate 102 and branched in the horizontal direction, in addition to the three remains, so that the same function is realized. The third concave portion 162 communicates with the ink flow passage, the fourth concave portion 163 communicates with the air flow passage, and the second flexible member 164 seals the third concave portion 162 and the fourth concave portion 163. Therefore, in the following description, the third concave portion 162 serving as an ink chamber is referred to as the third concave portion (ink chamber) 162 and the fourth concave portion 163 serving as an air chamber is referred to as the fourth concave portion (air chamber) 163.

In the embodiment, since a volume change amount for pressure adjustment can be increased as the displacement amount of the first flexible member 160 or the second flexible member 164 is larger. Therefore, the volume of the first concave portion 158 is configured to be greater than the volume of the third concave portion 162. Thus, the flow passage internal pressure adjustment mechanism 161 can perform predetermined pressure adjustment easily and highly accurately.

(B-1-3) Flow Passage of Flow Passage Member

The ink supplied from one of the self-sealing units 4 which are the negative pressure generation mechanism to the flow passage member 5 is supplied to the ejecting unit 6A of the head body 6 via the flow passage member 5.

Therefore, flow passages 151, 152, and 153 are formed as ink flow passages in the flow passage member 5. The flow passage 151 introduces the ink supplied from one of two self-sealing valve (not illustrated in FIG. 2) of one self-sealing unit 4 to the third concave portion 162. That is, the flow passage 151 descends from the bottom surface of one of the self-sealing units 4 through the flow passage substrate 103 from Z1 to Z2 in the third direction Z, extends from Ya1 to Ya2 in the fifth direction Ya horizontally between the bottom surface of the flow passage substrate 103 and the top surface of the flow passage substrate 104, ascends again through the flow passage substrate 103 from Z2 to Z1 in the third direction Z, and is opened to the third concave portion 162. The flow passage 152 communicates with the third concave portion 162 and the first concave portion 158 via the flow passage substrate 103 and the flow passage substrate 104. The flow passage 153 ascends through the flow passage substrate 104 from the first concave portion 158 on the side closer to Ya1 than the flow passage 152 in the fifth direction Ya from Z2 to Z1 in the third direction Z, extends from Ya2 to Ya1 in the fifth direction Ya horizontally between the bottom surface of the flow passage substrate 103 and the top surface of the flow passage substrate 104, is penetrated through the flow passage substrates 104 and 105 again to descend from Z1 to Z2 in the third direction, and communicates with a flow passage of the head body 6. The portion extending from Ya2 to Ya1 in the fifth direction Ya horizontally between the bottom surface of the flow passage substrate 103 and the top surface of the flow passage substrate 104 in the flow passage 153 overlap in the first direction X with the portion extending from Ya1 to Ya2 in the fifth direction Ya horizontally between the bottom surface of the flow passage substrate 103 and the top surface of the flow passage substrate 104 in the flow passage 151, and thus the extending portions are not illustrated.

(B-1-4) Functions of Flow Passage Internal Pressure Adjustment Mechanism and Flow Passage Opening and Closing Mechanism Thus, the flow passages 151, 152, and 153 extending from the self-sealing unit 4 which is the negative pressure generation mechanism to the ejecting unit 6A via the filter mechanism 6B of the head boy 6 are formed. The flow passage opening and closing mechanism 165 is structured to be disposed between the flow passages 151 and 152 and the flow passage internal pressure adjustment mechanism 161 is structured to be disposed between the flow passages 152 and 153. That is, the flow passage extending from the self-sealing unit 4 to the head body 6 via the flow passage opening and closing mechanism 165 and the flow passage internal pressure adjustment mechanism 161 oriented downward is formed, and thus a pressure inside this flow passage is adjusted by the flow passage internal pressure adjustment mechanism 161 and a space between the flow passage internal pressure adjustment mechanism 161 and the self-sealing unit 4 is opened and closed by the flow passage opening and closing mechanism 165. The flow passages 151, 152, and 153 are distributed and formed as the flow passages with the same configuration in the Xa-Ya planes of the flow passage substrates 103, 104, and 105 to correspond to the respective colors.

In the liquid ejecting head 3, the following actions and advantages are obtained. In such a kind of liquid ejecting head 3, a back pressure inside the head (a reservoir or a pressure chamber) is maintained to be a negative pressure in order to manage a meniscus position to handle continuous ejection. However, there is a concern of a bubble near a nozzle opening being drawn to the nozzle opening due to the negative pressure at the time of wiping or the like. When the bubble is drawn to the nozzle opening, nozzle clogging may occur.

Accordingly, in order to release the negative pressure, the volume inside the flow passage is decreased and the inside of the flow passage is pressurized by the flow passage internal pressure adjustment mechanism 161. At this time, when the entire volume inside the flow passage is large with respect to a change in the volume by the flow passage internal pressure adjustment mechanism 161, the pressurization inside the flow passage may not be effectively performed for the change in the volume. When a compliance portion is present inside the flow passage, the compliance portion absorbs the change in the volume, and thus the pressurization by the change in the volume of the flow passage internal pressure adjustment mechanism 161 may not be effectively performed. In particular, when the self-sealing unit 4 is used as the negative pressure generation mechanism, films 112 and 113 are used as flexible members, as will be described below. Therefore, the flexible members are compliance portions.

Accordingly, in order to effectively performs the pressurization, the flow passage opening and closing mechanism 165 is installed on the downstream side of the self-sealing unit 4 and the upstream side of the flow passage internal pressure adjustment mechanism 161, and thus the flow passage is closed by the flow passage opening and closing mechanism 165 before the pressurization is performed by the flow passage internal pressure adjustment mechanism 161.

To release the pressurization and set the negative pressure, flow passage opening and closing mechanism 165 is opened and the volume is increased by the flow passage internal pressure adjustment mechanism 161. When the volume is first increased by the flow passage internal pressure adjustment mechanism 161, there is a probability of a bubble being also drawn at the time of displacement in a direction in which a meniscus position is drawn. Conversely, when the flow passage opening and closing mechanism 165 is first opened, the ink can be supplied from the flow passage opening and closing mechanism 165 or from the upstream side of the flow passage opening and closing mechanism 165 despite the fact that the volume is increased by the flow passage internal pressure adjustment mechanism 161. Therefore, the probability of the bubble being also drawn can be reduced with the drawing of the meniscus position.

(B-2) Structure of Self-Sealing Unit

Figure 3A:
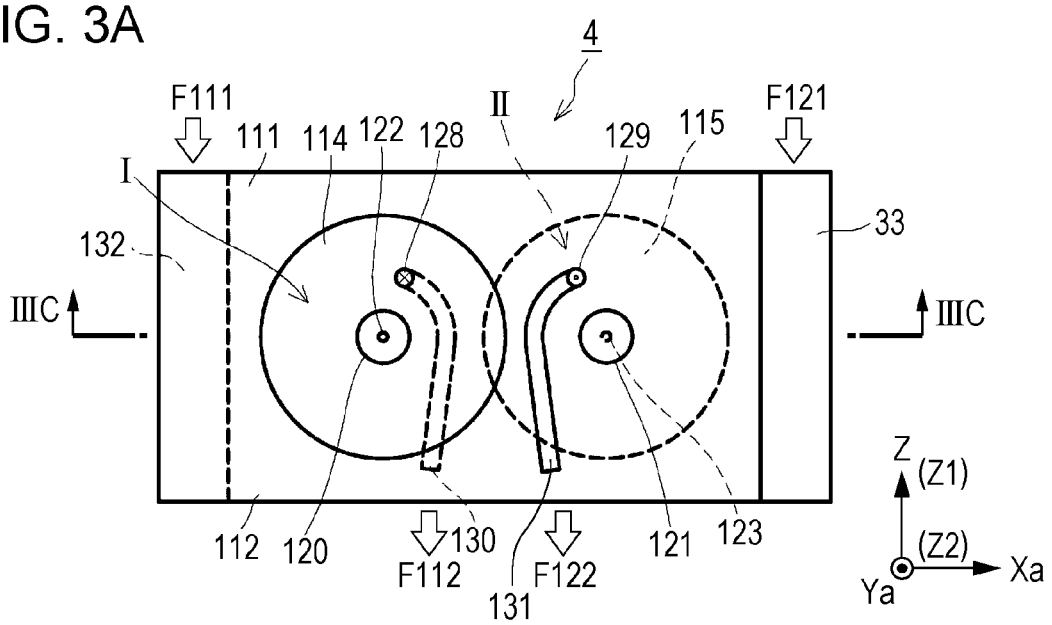
FIGS. 3A to 3C are diagrams illustrating a schematic configuration of an extracted self-sealing unit.
Figure 3B:
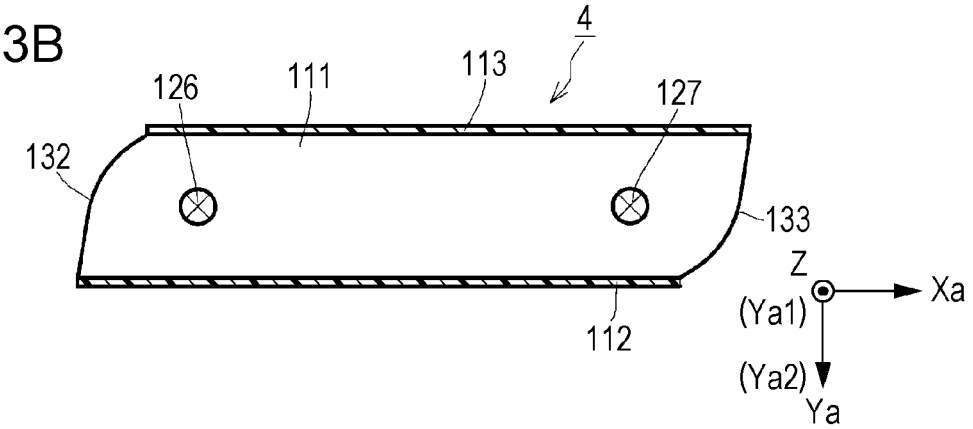
Figure 3C:
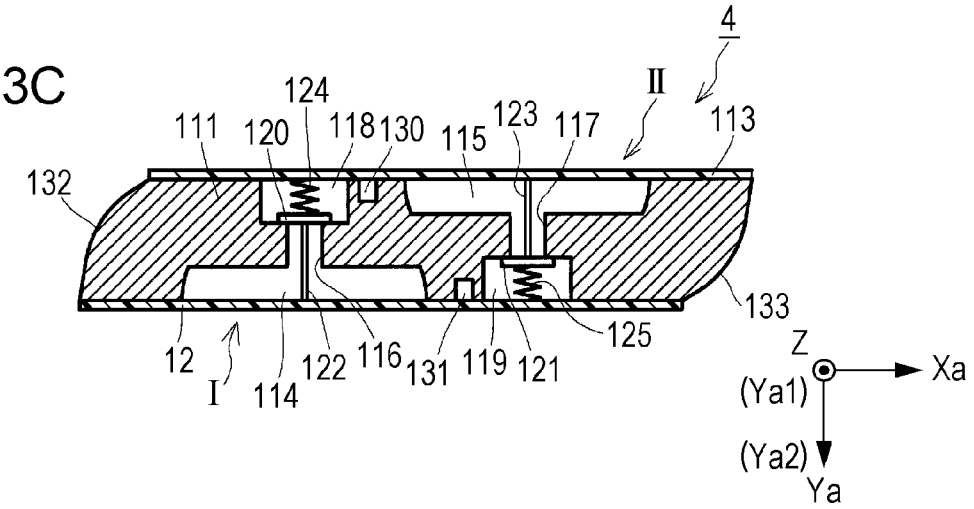

FIGS. 3A to 3C are diagrams illustrating a schematic configuration of an extracted self-sealing unit. FIG. 3A is a diagram illustrating the schematic configuration when viewed in the fifth direction Ya. FIG. 3B is a diagram illustrating the schematic configuration when viewed in the Z1 side in the third direction Z. FIG. 3C is a diagram illustrating the schematic configuration taken along the line IIIC-IIIC of FIG. 3A. As illustrated in the drawings, the self-sealing unit 4 is a member that has a substantially rectangular shape as a whole. The films 112 and 113 are attached to both side surfaces in the longitudinal direction of a body 111 by thermal welding or the like. That is, the self-sealing unit 4 has two film surfaces which are film surfaces in the fourth direction Xa and are surfaces facing each other in the fifth direction Ya.

On the other hand, a concave portion (see FIG. 3C) is formed on one surface on one side (the left side of the drawing) in the fourth direction Xa between two surfaces of the body 111 facing each other in the fifth direction Ya and the same concave portion (see FIG. 3C) is also formed on the other surface on the other side (the right side of the drawing) in the fourth direction Xa. The concave portions form a space sealed by the films 112 and 113. As a result, the films 112 and 113 are displaced in the fifth direction Ya by a change in a pressure in the space. That is, diaphragm chambers 114 and 115 are formed by the films 112 and 113 and the concave portions. Valve chambers 118 and 119 which are concave portions smaller than the concave portions and are portions sealed by the films 113 and 112 are formed via communication holes 116 and 117 on the opposite surface to the diaphragm chambers 114 and 115.

The other end of a shaft 122 passing through the communication hole 116 is fixed to a valve body 120. One end of the shaft 122 is fixed to the film 112 via a pressure reception plate or the like (not illustrated). That is, the valve body 120 is located on the opposite side to the film 112 with respect to the communication hole 116. In the embodiment, the side of the valve body 120 with respect to the communication hole 116 is referred to as a Ya1 side in the fifth direction Ya and the side of the film 112 with respect to the communication hole 116 is referred to as a Ya2 side in the fifth direction Ya. The valve body 120 is pressurized from the Ya1 side to the Ya2 side by a spring 124. The valve body 120 opens and closes the communication hole 116 through displacement of the film 112 and urging of the spring 124. The spring 124 is fixed to the body 111 via a spring holder (not illustrated) or the like.

The other end of a shaft 123 passing through the communication hole 117 is fixed to a valve body 121. One end of the shaft 123 is fixed to the film 113 via a pressure reception plate or the like (not illustrated). That is, the valve body 121 is located on the opposite side to the film 113 with respect to the communication hole 117. The valve body 121 is pressurized from the Ya2 side to the Ya1 side by a spring 125. The valve body 121 opens and closes the communication hole 117 through displacement of the film 113 and urging of the spring 125. The spring 125 is fixed to the body 111 via a spring holder (not illustrated) or the like. Thus, the valve bodies 120 and 121 adjacent in the fourth direction Xa are located on both sides of the mutual communication holes 116 and 117 in the fifth direction Ya.

Thus, when a negative pressure is acted on the diaphragm chambers 114 and 115, portions of the films 112 and 113 corresponding to the diaphragm chambers 114 and 115 are displaced in the fifth direction Ya by the atmospheric pressure or the like. As a result, the valve body 120 is moved to the Ya1 side in FIG. 3C to open the communication hole 116 and the valve body 121 is moved to the Ya2 side in FIG. 3C to open the communication hole 117. Here, the diaphragm chambers 114 and 115 are configured so that the negative pressure inside the head body 6 in association with ejection of the ink via the nozzle by the head body 6 is acted.

Thus, the self-sealing unit 4 according to the embodiment includes a self-sealing plate I formed by the film 112, the concave portion forming the diaphragm chamber 114, the valve body 120, the shaft 122, and the spring 124 and a self-sealing plate II formed by the film 113, the concave portion forming the diaphragm chamber 115, the valve body 121, the shaft 123, and the spring 125. Here, the self-sealing plates I and II are disposed to be separated in the fourth direction Xa. Thus, the shafts 122 and 123 of the valve bodies 120 and 121 are configured not to overlap each other in the third direction Z, and thus the dimensions of the self-sealing unit 4 in the third direction Z are set to be small.

An ink supply opening 126 supplying the ink to the side of the self-sealing plate I and an ink supply opening 127 supplying the ink to the side of the self-sealing plate II are formed in the top surface of the body 111 on the Z1 side in the third direction Z, and the ink supply openings 126 and 127 communicate with internal flow passages. Thus, inflow ink F111 flowing in the side of the self-sealing plate I via the ink supply opening 126 is supplied as outflow ink F112 from the bottom surface of the body 111 formed on the Z2 side to the head body 6, and inflow ink F121 flowing in the side of the self-sealing plate II is supplied as outflow ink F122 from the bottom surface of the body 111 to the head body 6 via the ink supply opening 127. More specifically, the ink supplied from the ink supply opening 126 reaches the valve chamber 118. In this state, when the negative pressure inside the head body 6 is acted, a negative pressure equal to or greater than a predetermined negative pressure is acted on the diaphragm chamber 114 is applied, and the valve body 120 opens the communication hole 116 through the displacement of the film 112, the ink accordingly flows in the inside of the diaphragm chamber 114 via the communication hole 116, is introduced to a flow passage 130 through which an outlet portion 128 approaches the diaphragm chamber 114 to descend to the rear surface side of the body 111, and is supplied as the outlet ink F112 to the head body 6 via an exhaust opening (not illustrated) of the bottom surface of the body 111.

On the other hand, the ink supplied from the ink supply opening 127 reaches the valve chamber 119. In this state, when the negative pressure is acted on the diaphragm chamber 115 and the valve body 121 opens the communication hole 117 through the displacement of the film 113, the ink accordingly flows in the diaphragm chamber 115 via the communication hole 117, is introduced to a flow passage 131 through which an outlet portion 129 approaches the diaphragm chamber 115 to descend to the front surface side of the body 111, and is supplied as the outlet ink F122 to the head body 6 via an exhaust opening (not illustrated) of the bottom surface of the body 111.

Further, in the embodiment, chamfered portions 132 and 133 are formed on both end surfaces of the body 111 in the fourth direction Xa in FIGS. 3A to 3C, and thus an occupation space in which the plurality of self-sealing units 4 are disposed is designed to be reduced as small as possible. That is, since the film surfaces of the films 112 and 113 of the self-sealing unit 4 are disposed in the fourth direction Xa, the outer appearance of the self-sealing unit 4 when viewed from the Z1 side in the third direction Z is rectangular and the dimensions of the self-sealing unit 4 in the first direction X may be increased. Accordingly, as illustrated in FIG. 3B, the dimensions of the self-sealing unit 4 in the first direction X are decreased by forming the chamfered portions 132 and 133 in the self-sealing unit 4.

Both of the flow passages 130 and 131 in the self-sealing plates I and II are disposed between the adjacent shafts 122 and 123 of the self-sealing plates I and II. As a result, the dimensions of the self-sealing unit 4 in the fourth direction Xa can be decreased compared to a case in which the flow passages 130 and 131 are disposed on both end surface sides of the body 111 from the shafts 122 and 123 in the fourth direction Xa. Further, when the chamfered portions 132 and 133 are formed on the end surfaces of the body 111 in the fourth direction Xa by disposing either the flow passage 130 or 131 between the shafts 122 and 123, the positions of the flow passages 130 and 131 are not obstacles, and thus an occupation space in which the plurality of self-sealing units 4 are disposed is designed to be reduced as small as possible.

When the self-sealing plates I and II according to the embodiment are seen transparently in the fifth direction Ya, as explicitly illustrated in FIG. 3A, some of the diaphragm chambers 114 and 115 are formed to overlap each other. The self-sealing plates I and II are located to be close to the middle portion of the body 111 in the fourth direction Xa by overlapping some of the diaphragm chambers 114 and 115 in this way. Accordingly, it is possible to reduce the dimensions of the self-sealing unit 4 in the fourth direction Xa and to easily form the chamfered portions 132 and 133.

In the self-sealing unit according to the embodiment, the ink pumped and supplied from the distribution unit 18 is discharged toward the flow passage member 5 via the diaphragm chambers 114 and 115 having the function of the self-sealing plate. Accordingly, even when the ink supplied from the ink supply source is pressurized, the negative pressure inside the head body 6 can be maintained.

(B-3) Lamination Structure of Flow Passage Member

Figure 4:
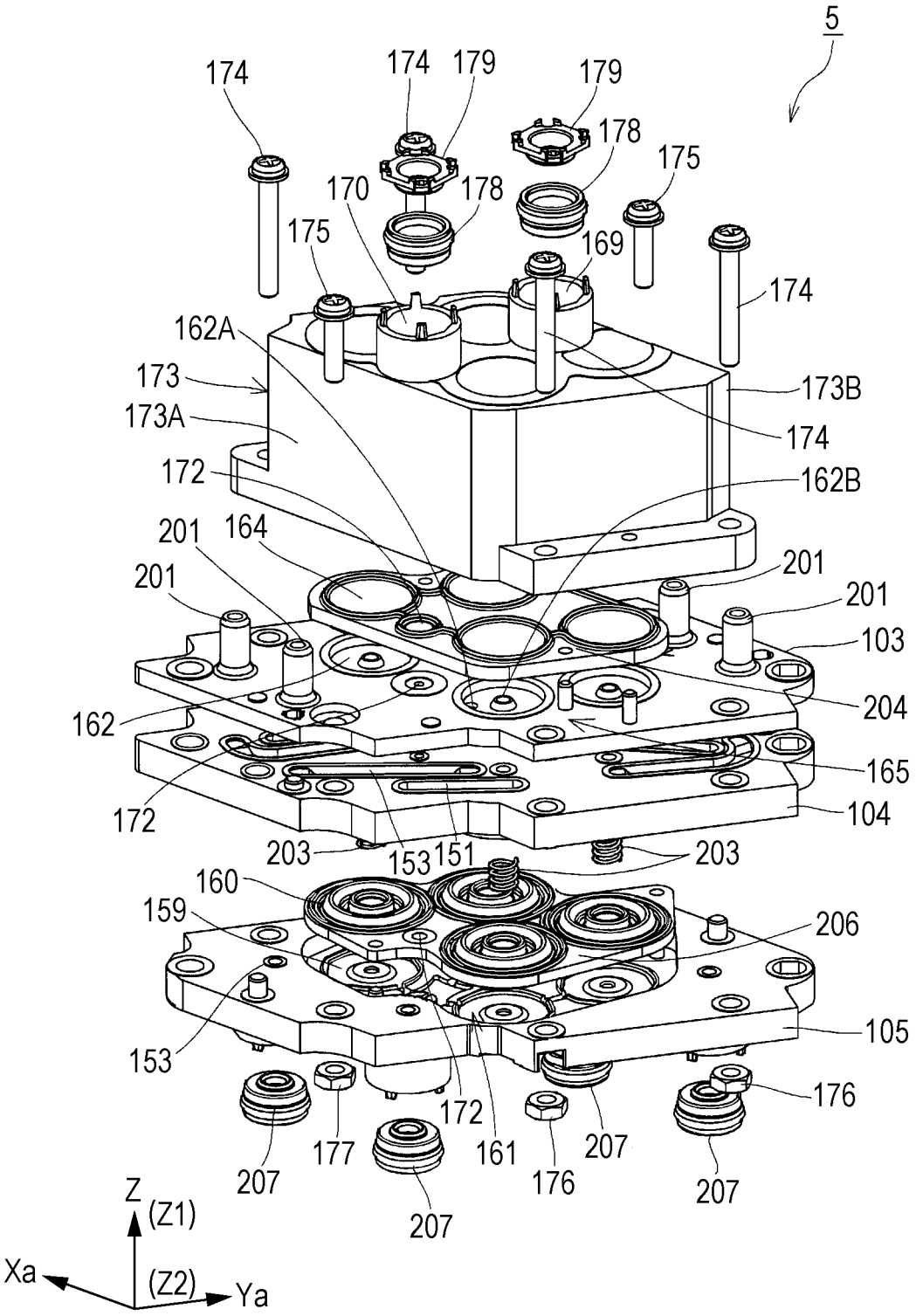
FIG. 4 is an exploded perspective view illustrating a flow passage member according to the embodiment of the invention.

FIG. 4 is an exploded perspective view illustrating the flow passage member according to the embodiment of the invention. In the drawing, the reference numerals are given to the same portions as those of FIG. 2, and the repeated description will be omitted.

In the flow passage member 5, the flow passage substrates 101 (see FIG. 2), 102 (see FIG. 2), 103, 104, and 105 are laminated. However, since the flow passage substrates 101 and 102 are received inside a housing 173, the flow passage substrates 101 and 102 are not illustrated. Air supply openings 169 and 170 are formed in the top surface of the housing 173. The air supply openings 169 and 170 are connected to the distribution unit 18 (not illustrated) via bushings 178 and washers 179 to communicate with the air supply source (not illustrated). Although not illustrated, the two self-sealing units 4,4 are disposed to come into contact with side wall surfaces 173A and 173B of the housing 173. The housing 173 and the laminated flow passage substrates 103 to 105 are strongly fastened by a plurality of fastening screws 174 and nuts 176 engaging with the fastening screws 174 to be integrated. The reason is as follows. The topmost member of the flow passage internal pressure adjustment mechanism 161 in the height direction forms the air flow passage 172 communicating with the flow passage opening and closing mechanism 165. A pressurized air is sent to the air flow passage 172. Accordingly, even when the pressurized air flows inside the air flow passage 172, the flow passage substrates 103 to 105 are strongly fixed by the fastening screws 174 and the nuts 176 to maintain the strength even in the air flow passage 172.

On the other hand, fastening screws 175 fixing the topmost member of the flow passage internal pressure adjustment mechanism 161 in the height direction integrate only the flow passage substrates 103 to 105 along with nuts 177 engaging with the fastening screw 175. This is because the fastening screws 175 are located at positions overlapping with a rubber which is the second flexible members 164 formed in the flow passage opening and closing mechanism 165.

In the embodiment, as described above, the flow passage substrates 101 to 105 are structured to be laminated and the reason is as follows. In the flow passage internal pressure adjustment mechanism 161, in order to easily change the volume inside the flow passage, the shape of the halfway flow passage is configured as a chamber shape in which a pressure reception area of the rubber which is the first flexible member 160 is broad and the posture of the rubber is displaced in the embodiment. Further, as will be described below, the flow passage internal pressure adjustment mechanism 161 of each color is disposed on the same plane to form the rubber of the colors of CMYK as a single rubber rather than different members. Therefore, an excessive space in the in-plane direction Xa-Ya in which the rubber is disposed is set to be small. Accordingly, the flow passage internal pressure adjustment mechanism 161 and the flow passage opening and closing mechanism 165 are separately laminated in different layers.

The lamination positions of the flow passage internal pressure adjustment mechanism 161 and the flow passage opening and closing mechanism 165 for each color of CMYK are the same, and thus the rubbers which are the first flexible members 160 of the flow passage internal pressure adjustment mechanism 161 and the second flexible members 164 of the flow passage opening and closing mechanism 165 can be disposed on the same plane between the colors. Therefore, positions at which a reactive force is generated can be set on the same plane, and thus the flow passage substrates 101 to 105 structured to be laminated can be strongly fixed. The second flexible members 164 for the respective colors of CMYK may be formed of a single rubber. This structure is preferable from the viewpoint of pinching of the rubber.

Since the lamination positions of the flow passage internal pressure adjustment mechanism 161 and the flow passage opening and closing mechanism 165 are the same, lamination positions of the ink flow passages and the air flow passages between the flow passage internal pressure adjustment mechanism 161 and the flow passage opening and closing mechanism 165 can be set to be the same for CMYK. Accordingly, the flow passage substrates 103 to 105 which are the laminated substrates forming the respective flow passages can also be formed of a single member in CMYK.

In the embodiment, the flow passage opening and closing mechanism 165 on the upstream side of the ink and the flow passage internal pressure adjustment mechanism 161 on the downstream side are laminated. Therefore, the flow passage substrates 103 to 105 which are the laminated substrates forming the flow passage opening and closing mechanism 165 and the flow passage internal pressure adjustment mechanism 161 are piled from the upstream side in order of the fourth concave portion (air chamber) 163 of the flow passage opening and closing mechanism 165→the third concave portion (ink chamber) 162 of the flow passage opening and closing mechanism 165→the first concave portion (ink chamber) 158 of the flow passage internal pressure adjustment mechanism 161→the second concave portion (air chamber) 159 of the flow passage internal pressure adjustment mechanism 161. By forming the flow passage substrates 103 and 104 for the lamination of the ink as the third and fourth layers continuously in sequence from the upper side, it is possible to reduce the numbers of through holes and grooves for the ink flow passages in the laminated substrates. Since the air for the flow passage opening and closing mechanism 165 and the air for the flow passage internal pressure adjustment mechanism 161 are pressurized and controlled at different timings, as will be described below, the different air flow passages 171 and 172 have to be set. When the laminated substrates for the air are continued in the second and third layers from the upper side and laminated substrates for the air flow passages are interposed therebetween, the number of laminated substrates may be increased.

For the third concave portion 162 which is the ink chamber of the flow passage opening and closing mechanism 165 and the first concave portion 158 which is the ink chamber of the flow passage internal pressure adjustment mechanism 161, the volume of the latter is greater than the volume of the former. This is because the flow passage opening and closing mechanism 165 may open and close the flow passage, but the flow passage internal pressure adjustment mechanism 161 is desired to have a larger variation width in order to change the volume of the flow passage and adjust the pressure inside the flow passage. Therefore, an area in which the flow passage internal pressure adjustment mechanism 161 is installed is greater than an area in which the flow passage opening and closing mechanism 165 is installed. In order to miniaturize the entire housing, the flow passage opening and closing mechanisms 165 are disposed on the side of the self-sealing units 4 which are the negative pressure generation mechanism and the flow passage internal pressure adjustment mechanisms 161 are disposed on the opposite side with respect to the layer in which the flow passages from the negative pressure generation mechanism (the self-sealing units 4) are formed. As a result, the flow passage opening and closing mechanisms 165 are disposed between the self-sealing units 4 in the in-plane direction Xa-Ya of the layer. The volume of each of the flow passage internal pressure adjustment mechanism 161 and the flow passage opening and closing mechanism 165 in which the first concave portion 158 and the third concave portion 162 which are the ink chambers are sealed by the rubber serving as the first and second flexible members is assumed to refer to a volume in a state in which the first flexible member 160 and the second flexible member 162 are not displaced.

It is necessary for the flow passage 153 from the flow passage internal pressure adjustment mechanism 161 to reach four corners of the head unit in consideration of access to a relay substrate disposed on the X-Y plane on the downstream side of the flow passage 153. When seen transparently in the lamination direction, the third concave portion 162 which is the ink chamber of the flow passage opening and closing mechanism 165 and the first concave portion 158 which is the ink chamber of the flow passage internal pressure adjustment mechanism 161 are disposed to overlap partially.

The air supply source of the flow passage internal pressure adjustment mechanisms 161 is common. However, since the air flow passages in which through holes are formed from the air supply opening 170 to the flow passage substrates 101 to 104 in the lamination direction are drawn, the air flow passages of the flow passage internal pressure adjustment mechanisms 161 are branched to the lowermost side in the lamination direction. Thus, since the number of through holes formed in the laminated substrates can be reduced compared to a case in which the air flow passages are branched to the uppermost side in the lamination direction, contribution to miniaturization particularly in the X-Y direction can be realized.

A seal member 204 is a member that is interposed between the flow passage substrate 103 and the flow passage substrate 102 (not illustrated in FIG. 4) and seals the third concave portion 162 which is the ink chamber and the fourth concave portion 163 (not illustrated in FIG. 4) which is the air chamber. A seal member 206 is the first flexible member 160 formed of a flexible rubber member that is interposed between the flow passage substrate 105 and the flow passage substrate 104 and seals the second concave portion 159 which is the air chamber and the first concave portion 158 (not illustrated in FIG. 4) which is the ink chamber. The first flexible members 160 according to the embodiment are integrated for the four colors of CYMK.

The first flexible member 160 is normally urged toward the second concave portion 159 by a spring 203 which is an urging mechanism. As a result, the volume of the first concave portion 158 (not illustrated in FIG. 4), that is, the volume of the flow passage internal pressure adjustment mechanism 161, is maximum usually.

The ink supplied from the self-sealing units 4 (see FIG. 2) flows from four ink inlets 201 formed in the flow passage substrate 103 and leads to the flow passage 151. That is, the ink descends from Z1 to Z2 in the third direction Z, subsequently passes through the horizontal flow passage formed in the flow passage substrate 104, subsequently ascends from Z2 to Z1 in the third direction Z, and subsequently reaches the third concave portion 162 of the flow passage substrate 103 via a hole 162A. Further, the ink passes through the flow passage 152 via a hole 162B of the third concave portion 162 and reaches the first concave portion 158 (not illustrated in FIG. 4) formed in the rear surface of the flow passage substrate 104. Thereafter, the ink is supplied to the head body 6 (not illustrated in FIG. 4) communicating via a bushing 207 via the flow passage 153 formed in the flow passage substrate 104.

(B-4) Head Body

Figure 5:
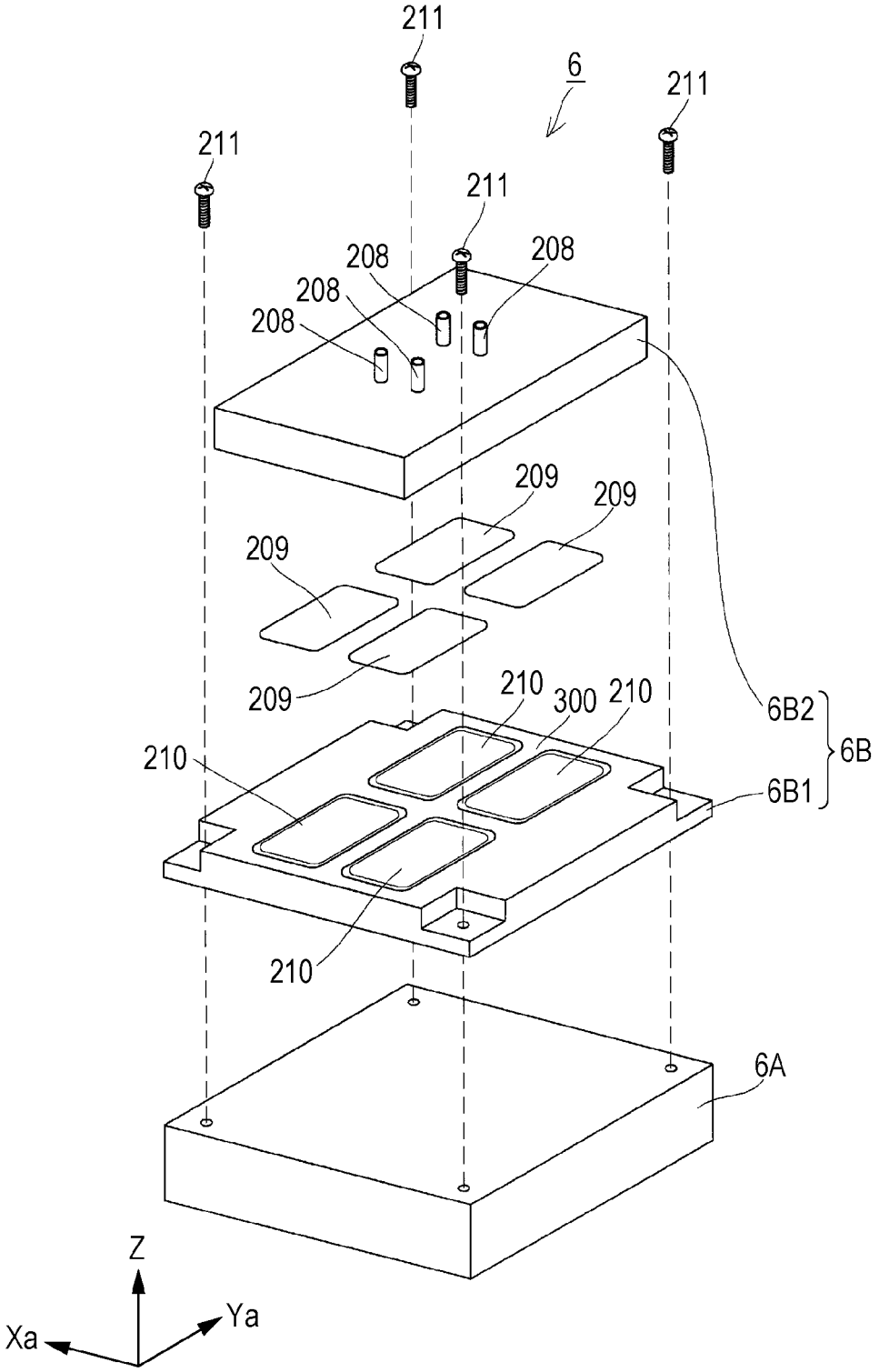
FIG. 5 is an exploded perspective view illustrating a head body according to the embodiment of the invention.
Figure 6A:
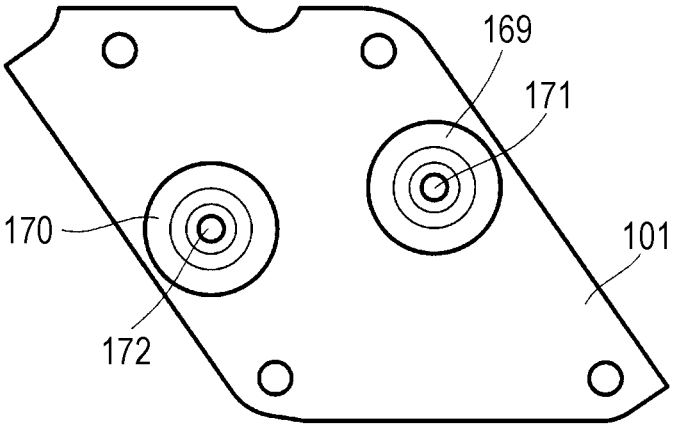
FIGS. 6A and 6B are a top view and a rear view illustrating a flow passage substrate.
Figure 6B:
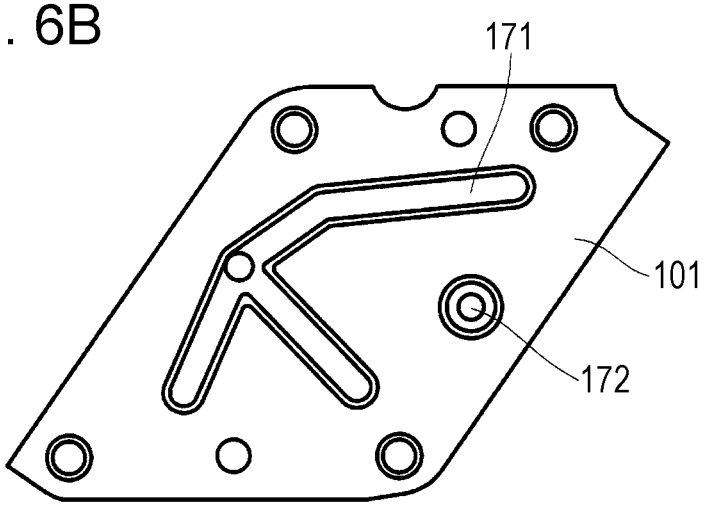
Figure 7A:
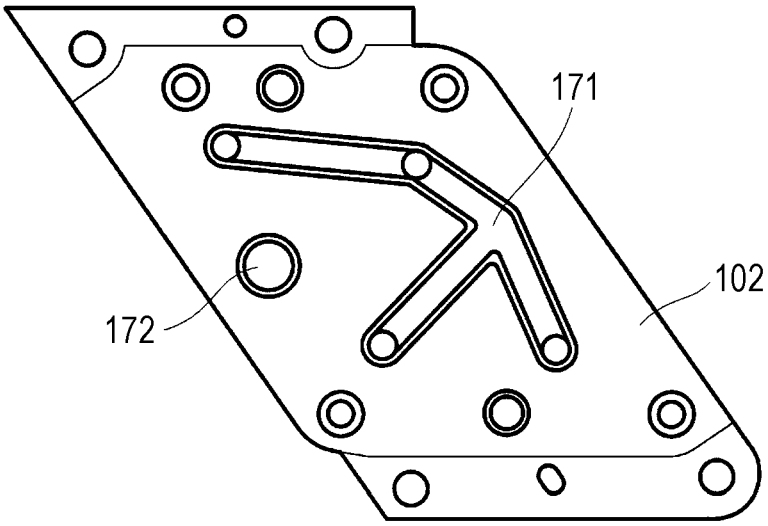
FIGS. 7A and 7B are a top view and a rear view illustrating the flow passage substrate.
Figure 7B:
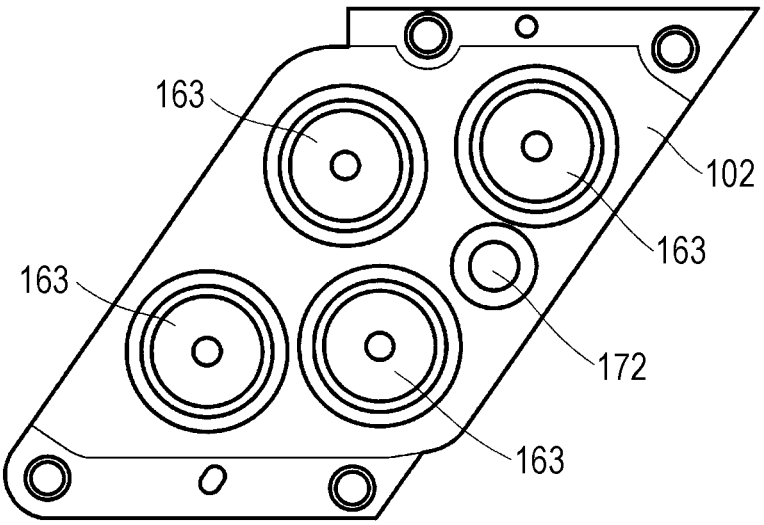
Figure 8A:
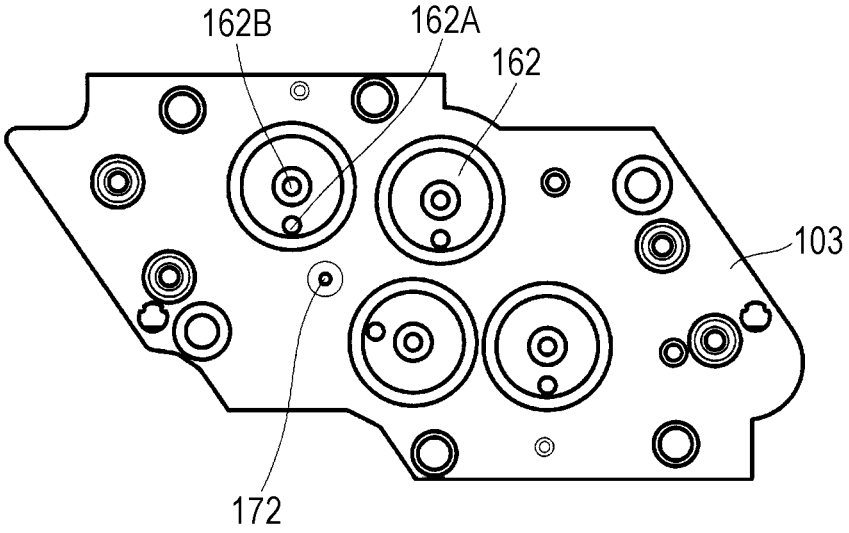
FIGS. 8A and 8B are a top view and a rear view illustrating the flow passage substrate.
Figure 8B:
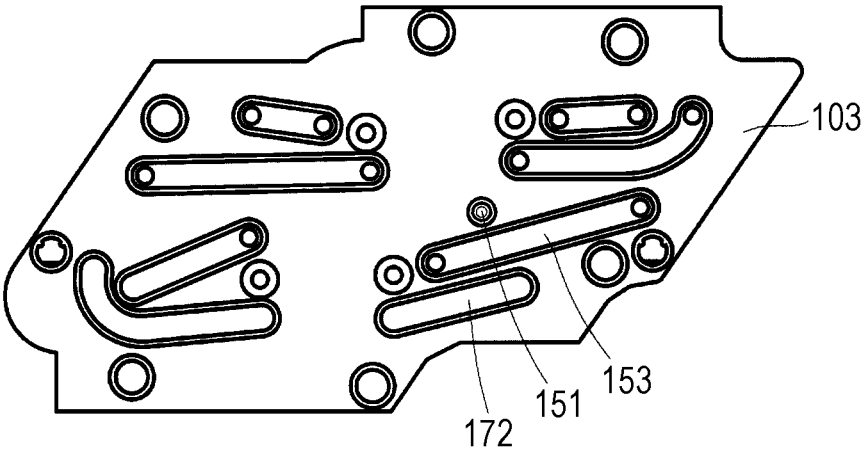

FIG. 5 is an exploded perspective view illustrating the head body 6 according to the embodiment of the invention. As illustrated in the drawing, the head body 6 includes an ejecting unit 6A and a filter mechanism 6B which are integrated by fixing the filter mechanism 6B to the ejecting unit 6A by screws 211. The filter mechanism 6B includes a filter portion 6B1 and a case portion 6B2. By connecting the flow passage member 5 to four ink inlets 208 corresponding to the respective colors of CMYK of the case portion 6B2 via the bushings 207 illustrated in FIG. 4, the head body 6 is connected to the self-sealing units 4 (see FIG. 2) via the flow passage member 5 and to the ink cartridge 350 (see FIG. 1) which is the ink supply source via the opening and closing valve 351. Filters 209 are formed of a thin metallic wire in a mesh shape and circulate the ink to capture and remove foreign matters in the ink. The filters 209 are disposed openings 210 formed in a case 300 of the filter portion 6B1. As a result, the foreign matters in the ink supplied from the flow passage member 5 are removed by the filters 209 for the respective colors of CMYK, so that the ink is supplied to the ejecting unit 6A.

The ejecting unit 6A ejects ink droplets via nozzle openings (not illustrated), for example, through driving of driving elements such as piezoelectric actuators. Accordingly, the pressure generation mechanism is not particularly limited, for example, as long as a change in a pressure occurs in the pressure generation chamber filled with the ink by the pressure generation mechanism. The piezoelectric actuators laminated in the third direction Z can be properly applied. Examples of such kinds of piezoelectric actuators include thin film type piezoelectric actuators formed by thin forming or lithography methods or thick film type piezoelectric actuators formed by methods of attaching green sheets. As the piezoelectric actuator, a vertical vibration type piezoelectric actuator which is formed by alternately laminating a piezoelectric material and an electrode forming material and is expanded or contracted in an axial direction can be used. As the pressure generation mechanism, an actuator in which a heat generation element is disposed in a pressure generation chamber and which ejects a liquid droplet from a nozzle opening by a bubble generated by the heat generated by the heat generation element can also be used. Further, a so-called electrostatic actuator which generates an electrostatic force between a vibration plate and an electrode, deforms the vibration plate by the electrostatic force, and ejects an ink droplet from a nozzle opening can also be used.

Figure 11A:
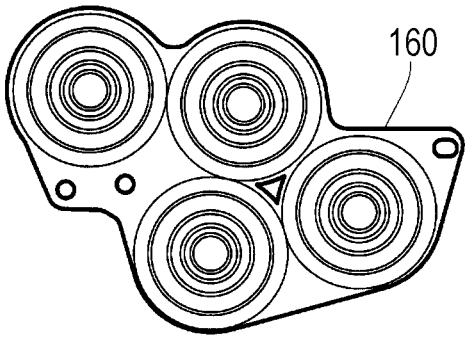
FIGS. 11A and 11B are a top view and a rear view illustrating a first flexible member.
Figure 11B:
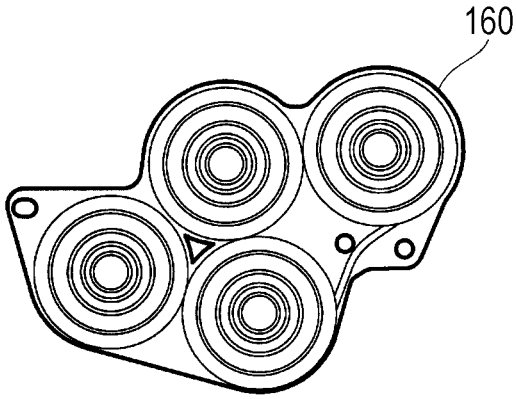
Figure 12A:
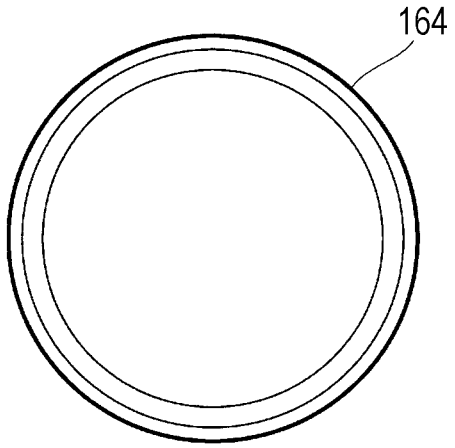
FIGS. 12A and 12B are a top view and a rear view illustrating a second flexible member.
Figure 12B:
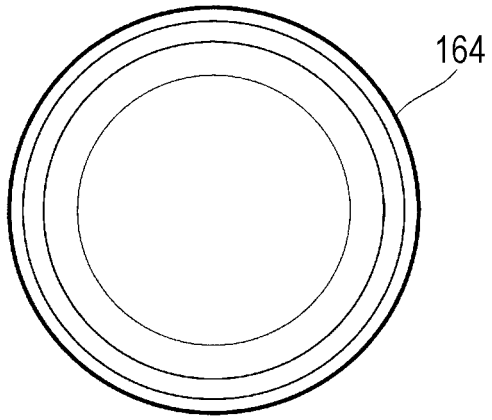

(B-5) Characteristics and Shapes of Each Laminated Substrate and Each Elastic Member Of the plan views of the flow passage substrates 101 to 105, FIGS. 6A to 10A are front views when viewed from the Z1 side and FIGS. 6B to 10B are rear views when viewed the Z2 side. FIG. 11A is a top view illustrating the first flexible member and FIG. 11B is a rear view illustrating the first flexible member. FIG. 12A is a plan view illustrating the second flexible member and FIG. 12B is a rear view illustrating the second flexible member. The liquid ejecting head 3 according to the embodiment will be continuously described in addition to these drawings. In these drawings, the same reference numerals are given to the same portions as those of FIGS. 2 to 4 and the repeated description will be omitted.

The films 112 and 113 are formed as elastic members of the self-sealing units 4 which are the negative pressure generation mechanism according to the embodiment. Conversely, the first flexible member 160 and the second flexible member 164 which are elastic members of the flow passage internal pressure adjustment mechanism 161 and the flow passage opening and closing mechanism 165 are formed of a rubber. The reason is as follows. When a rubber and a film are compared to each other as a flexible member, it is to pinch the rubber strongly using a screw in order to fix the rubber. Conversely, since the film may be fixed by thermal welding or the like, the film is easy to fix from the viewpoint of fixing of a flexible member. Even from the viewpoint of cost, a film is generally cheaper. However, from the viewpoint of a displacement amount, a rubber can be further displaced although the displacement amount also depends on the shape of a rubber. A responsive property necessary for the displacement is generally better in a rubber although the responsive property also depends on the shape of a rubber. Since a large displacement amount is not necessary for the self-sealing unit 4 which is the negative pressure generation mechanism, a film is used in consideration of an attaching work or cost. As will be described below, a film is better from the viewpoint of absorption of ink flow caused in an operation of the flow passage opening and closing mechanism 165. On the other hand, for the flow passage internal pressure adjustment mechanism 161 and the flow passage opening and closing mechanism 165, a mechanism with a good responsive property which is switching between the time of wiping or the like and the time of end of the wiping or the like is preferable in order to shorten a time necessary for the wiping which is a goal of the mechanism. A mechanism with a larger displacement amount than the self-sealing unit 4 which is the negative pressure generation mechanism is preferable. Accordingly, a rubber is used for the first flexible member 160 and the second flexible member 164.

In the embodiment, the negative pressure generation mechanism is vertically disposed, whereas the flow passage internal pressure adjustment mechanism 161 and the flow passage opening and closing mechanism 165 are horizontally disposed. That is, the self-sealing unit 4 is disposed so that the displacement direction of the film which is the flexible member in the self-sealing unit 4 which is the negative pressure generation mechanism is a direction perpendicular to the third direction Z. The flow passage internal pressure adjustment mechanism 161 and the flow passage opening and closing mechanism 165 are disposed so that the displacement directions of the first flexible member 160 and the second flexible member 164 which are the flexible members of the flow passage internal pressure adjustment mechanism 161 and the flow passage opening and closing mechanism 165 are the third direction Z. The reason is as follows. In the case of the vertical disposition, there is a concern of bubbles gathering on the upper side due to buoyancy. In the case of the horizontal disposition, there is a probability of the gathering bubbles being reduced. An entrance of the flow passage in the flow passage opening and closing mechanism 165 is present on the lower side of the laminated flow passage substrate 103, which is not problematic because of the horizontal disposition. By vertically disposing the self-sealing unit 4 for which the pressure reception areas of the films 112 and 113 which are the flexible members are preferably large, rather than horizontally disposing the self-sealing unit 4, miniaturization is realized from the viewpoint of an installation area space. For example, when the self-sealing unit 4 is horizontally disposed as a comparative example, the layers of the flow passage internal pressure adjustment mechanism 161 and the flow passage opening and closing mechanism 165 have to be switched and laminated in order to ensure the pressure reception areas. However, in this case, the dimensions in the lamination direction (vertical direction) may be increased. By using layers from the self-sealing unit 4 to the flow passage opening and closing mechanism 165 in common between the colors of CMYK, the dimensions in the lamination direction are decreased and the number of components is reduced.

In a modification example, as illustrated in FIG. 2, the self-sealing units 4 are disposed on both sides of the flow passage member 5 and the flow passage internal pressure adjustment mechanism 161 and the flow passage opening and closing mechanism 165 are disposed in the middle portion of the flow passage member 5. Accordingly, it is possible to decrease the lengths of the flow passages or the dimensions necessary for the drawing of the flow passages between the self-sealing units 4,4 and the flow passage opening and closing mechanism 165 and the length of the flow passage between the flow passage opening and closing mechanism 165 and the flow passage internal pressure adjustment mechanism 161 or the dimensions necessary for the drawing of the flow passage. For example, when both of the self-sealing units 4,4 of CMYK are disposed on one side of the flow passage member 5 and the flow passage internal pressure adjustment mechanism 161 and the flow passage opening and closing mechanism 165 of CMYK are disposed on the other side of the flow passage member 5 as a comparative example, the lengths of the flow passages may be increased, and thus the increase in the lengths of the flow passages is not preferable from the viewpoint of a pressure loss and an exhaust property. The flow passage communicating with one of the self-sealing unit 4 and the flow passage member 5 and the flow passage communicating the other self-sealing unit 4 and the flow passage member 5 may be drawn to be lined up in the first direction X, and thus the dimensions necessary for the drawing may be increased and the increase in the dimensions is not preferable for miniaturization of the entire liquid ejecting head 3.

In association with the degree of pressurization or a buffer amount by the flow passage internal pressure adjustment mechanism 161 according to the embodiment, the degree of pressurization of the flow passage internal pressure adjustment mechanism 161 depends on 1) the number of nozzle openings on the downstream side, 2) the degree of hemisphere of the meniscus, and 3) a compliance function inside the reservoir or the pressure chamber in the ejecting unit 6A. As an example of a change amount of the volume of the flow passage by the flow passage internal pressure adjustment mechanism 161 (the invention is not necessarily limited thereto), the change amount can be greater than the volume of the reservoir of the ejecting unit 6A. In this degree of pressurization, the pressurization can be effectively performed even when a plurality of nozzles are formed in regard to the reservoir.

The displacement amount of the first flexible member 160 is specified by an interval between the first flexible member 160 and the wall surface of the first concave portion 158 which is the ink chamber facing the first flexible member 160. That is, in a stage in which the first flexible member 160 is displaced to come into contact with the wall surface of the corresponding first concave portion 158, the pressurization is performed on the fluid as a target value. Accordingly, compared to a case in which the first flexible member 160 is displaced infinitely, it is possible to easily perform the pressurization up to the desired degree and prevent fracture or the like of the rubber due to excessive pressurization.

In the embodiment, the flow passage is closed by the flow passage opening and closing mechanism 165 before the volume of the flow passage is changed by the flow passage internal pressure adjustment mechanism 161. However, since the third concave portion 162 and the second flexible member 164 are used in the flow passage opening and closing mechanism 165, the volume of the flow passage and the pressure inside the flow passage can be changed even by the flow passage opening and closing mechanism 165. Accordingly, for example, a meniscus resistant pressure and a compliance of the reservoir or tensile strengths of the films 112 and 113 of the self-sealing unit 4 can be properly set so that the ink does not flow from the nozzle opening. Specifically, flow passage resistance from the flow passage opening and closing mechanism 165 to the self-sealing unit 4 which is the negative pressure generation mechanism is set to be less than a flow passage resistance from the flow passage opening and closing mechanism 165 to the nozzle opening. Thus, even when the flow passage is closed by the flow passage opening and closing mechanism 165, the ink can be configured not to flow from the nozzle opening.

Figure 9A:
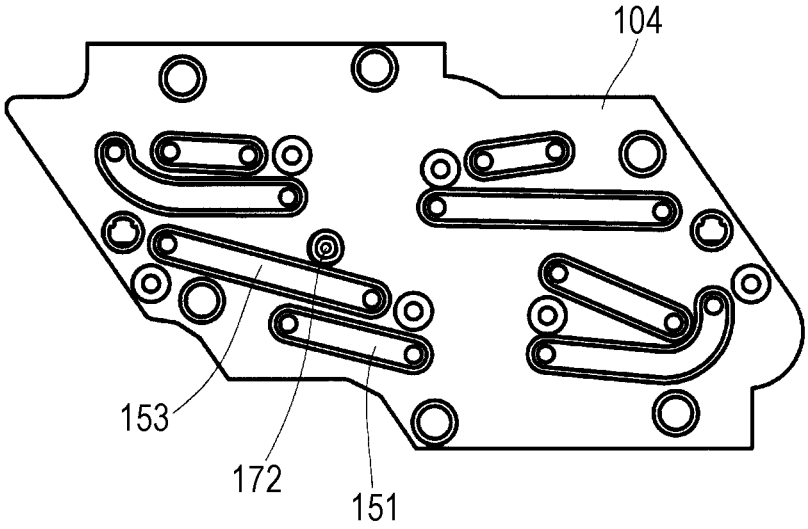
FIGS. 9A and 9B are a top view and a rear view illustrating the flow passage substrate.
Figure 9B:
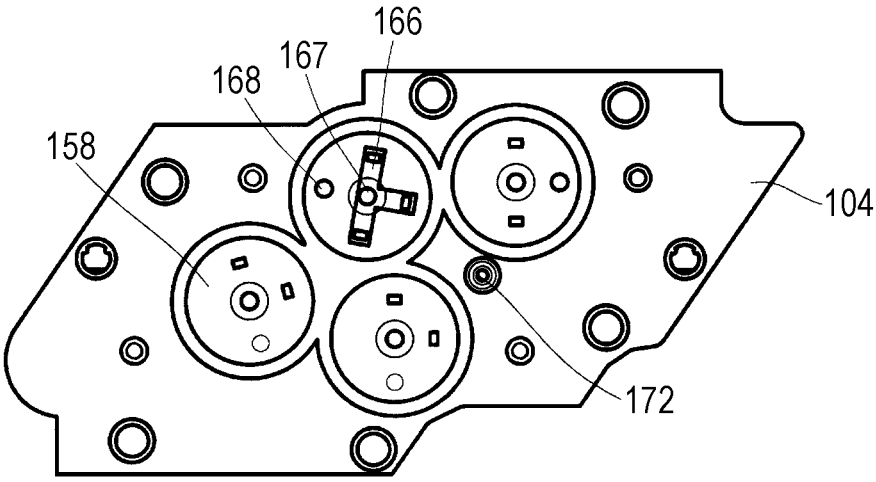
Figure 10A:
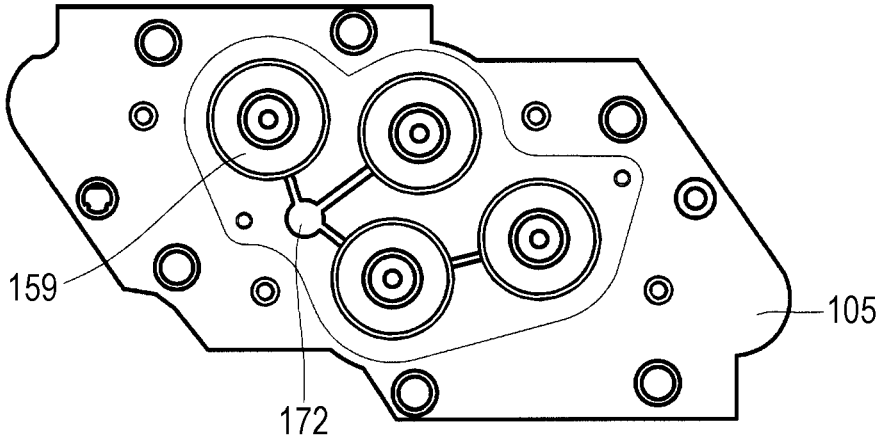
FIGS. 10A and 10B are a top view and a rear view illustrating the flow passage substrate.
Figure 10B:
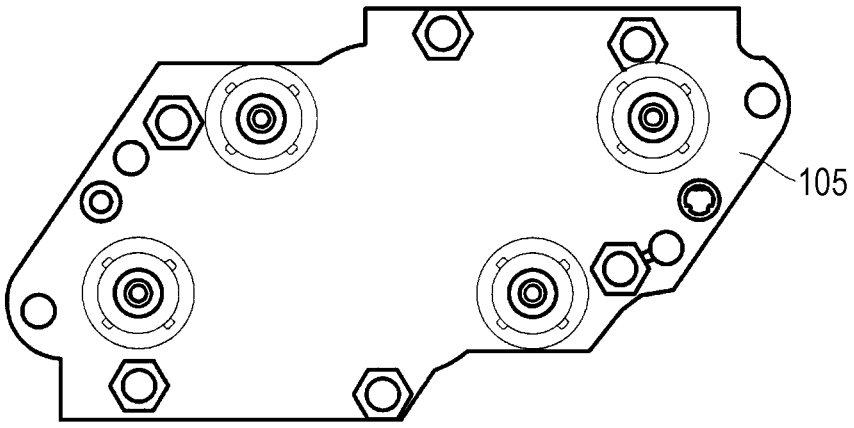

A groove 166 dilating radially from a supply opening 167 is formed on the upper surface of the inside of the first concave portion 158 which is the ink chamber of the flow passage internal pressure adjustment mechanism 161 according to the embodiment, as illustrated in FIG. 9B. This is because the first concave portion 158 which is the ink chamber of the flow passage internal pressure adjustment mechanism 161 has a cross-sectional circle shape and the ink flowing from the supply opening 167 at the center of the circle flows out from an exhaust opening 168 disposed in the direction of any of the dots on an arc from the center of the circle. That is, when the first flexible member 160 partitioning the first concave portion 158 and the second concave portion 159 which are the ink chamber and the air chamber is bent toward the side of the first concave portion 158 which is the ink chamber by the pressurization of the flow passage internal pressure adjustment mechanism 161 to the second concave portion 159, there is a probability of the supply opening of the fluid being blocked by the rubber which is the first flexible member 160 depending on a bending amount of the first flexible member 160. Further, even in choking suction (suction in which the negative pressure gathers by closing the halfway of the flow passage when an enclosed space formed by capping on the surface of the nozzle opening is sucked and the ink is forcibly sent from the nozzle opening), there is a probability of the supply opening being blocked by the rubber. Accordingly, by forming the supply opening 167 on the side of the ink chamber of the flow passage internal pressure adjustment mechanism 161 on the bottom of the groove 166 formed at the center of the circle and dilating the groove 166 in the direction of any of the dots on the arc from the center of the circle, the groove 166 can ensure a path of the ink as an ink flow passage and the supply opening 167 or a path from the supply opening 167 to the exhaust opening 168 is not blocked even when the first flexible member 160 is bent.

The dilating direction of the groove 166 may not be on a straight line from the supply opening 167 to the exhaust opening 168 in consideration of the exhaust property inside the first concave portion 158 which is the ink chamber. This is because when the dilating direction is not on the straight line, a direction in which the ink flows inside the first concave portion 158 may be changed due to the bending of the first flexible member 160 and a bubble staying inside the first concave portion 158 is easily exhausted due to the change in the flow before the flow is changed.

In particular, as illustrated in FIG. 4, when there is the spring 203 urging the first flexible member 160 from the first concave portion (the ink chamber) 158 to the second concave portion (the air chamber) 159 inside the flow passage internal pressure adjustment mechanism 161, the first flexible member 160 inside the flow passage internal pressure adjustment mechanism 161 has a shape capable of maintaining a state in which the first flexible member 160 is displaced toward the second concave portion (the air chamber) 159 and a state in which the first flexible member 160 is displaced toward the first concave portion (the ink chamber) 158. When the state in which the first flexible member 160 is displaced toward the first concave portion (the ink chamber) 158 occurs during printing, for example, the gap between the supply opening 167 and the first flexible member 160 may be narrowed, and thus a pressure loss may be large. Accordingly, it is preferable to install the spring 203 urging the first flexible member 160 from the first concave portion (the ink chamber) 158 to the second concave portion (the air chamber) 159 in order to prevent such displacement from occurring during printing. When a rubber is used as the first flexible member 160 inside the flow passage internal pressure adjustment mechanism 161, a two-stable rubber is preferably used in order to maintain the displaced states. In a state in which the second concave portion (the air chamber) 159 is opened to the atmosphere (default state), a hollow posture can be maintained on the side of the second concave portion (the air chamber) 159 by the urging of the spring 203. For example, the second concave portion (the air chamber) 159 may be sucked instead of or along with the urging of the spring 203. Thus, it is possible to reliably prevent the first flexible member 160 from being displacement during printing.

In the state in which the second concave portion (the air chamber) 159 is opened to the atmosphere (default state), the first flexible member 160 is hollowed toward the second concave portion (the air chamber) 159 and, as the result of the urging, the first flexible member 160 preferably comes into contact with the corresponding side surface of the second concave portion (the air chamber) 159. Thus, compared to a case in which the first flexible member 160 does not come into contact with any portion, it is possible to reliably prevent the first flexible member 160 from being displaced during printing.

On the other hand, a spring urging the second flexible member 164 is not installed in the flow passage opening and closing mechanism 165. The reason is as follows. The flow passage internal pressure adjustment mechanism 161 and the flow passage opening and closing mechanism 165 are laminated to be fixed by common screws. At this time, when springs are present in both of the flow passage internal pressure adjustment mechanism 161 and the flow passage opening and closing mechanism 165, assembly is difficult. When the rubber is used as the second flexible member 164 of the flow passage opening and closing mechanism 165, a membranous rubber is preferably used unlike the first flexible member 160 inside the flow passage internal pressure adjustment mechanism 161 (see FIGS. 12A and 12B). Thus, a state in which a displaced pasture is not maintained and the rubber of the second flexible member 164 inside the flow passage opening and closing mechanism 165 blocks the flow of the ink inside the flow passage opening and closing mechanism 165 can rarely occur, compared to the state inside the flow passage internal pressure adjustment mechanism 161. Accordingly, by not installing a spring urging the second flexible member 164 inside the flow passage opening and closing mechanism 165, the assembly becomes easy.

When the flow passage opening and closing mechanism 165 and the flow passage internal pressure adjustment mechanism 161 are disposed on the same plane, it is not difficult to perform the assembly. Therefore, a spring urging the second flexible member 164 inside the flow passage opening and closing mechanism 165 may be installed. Thus, it is possible to prevent the second flexible member 164 from being displaced during printing. For example, the fourth concave portion (the air chamber) 163 may be sucked instead of or along with the urging of the spring.

When the negative pressure is released in the first flexible member 160 inside the flow passage internal pressure adjustment mechanism 161, it is necessary to decrease the volume of the first concave portion 158 (the ink chamber). Therefore, as illustrated in FIGS. 11A and 11B, a shape is formed so that the displacement amount is greater than that of the second flexible member 164 inside the flow passage opening and closing mechanism 165. Specifically, the displacement amount is increased by causing the thickness of the arc to be thinner than the thickness of the center of the circle and bending the thin portion in the displacement direction. To switch the posture of the rubber between two stages of a case of the releasing of the negative pressure and a case of non-releasing of the negative pressure, a so-called two-stable rubber is used so that the posture of the rubber can be stably switched.

The second flexible member 164 of the flow passage opening and closing mechanism 165 may be formed as a membranous rubber rather than the so-called two-stable rubber, as illustrated in FIGS. 12A and 12B. To dispose the so-called two-stable rubber, an installation area greater than that of the membranous rubber is necessary. However, by forming the second flexible member 164 of the flow passage opening and closing mechanism 165 as the membranous rubber, it is possible to decrease the installation area necessary for the flow passage opening and closing mechanism 165. In the embodiment, as illustrated in FIG. 2, the size of the flow passage substrate 102 is set to be smaller than that of the flow passage substrate 103 in the fifth direction Ya, and the self-sealing units 4 are disposed on both sides of the flow passage opening and closing mechanism 165. That is, the self-sealing units 4 are disposed in the third direction Z at the same lamination position as at least one of the flow passage substrates 102 and 103 in which the flow passage opening and closing mechanisms 165 are formed. Thus, the liquid ejecting head 3 is miniaturized.

In regard to the distribution of the air flow passages, it is necessary to install the third concave portion 162 which is the ink chamber inside the flow passage opening and closing mechanism 165 and the first concave portion 158 which is the ink chamber inside the flow passage internal pressure adjustment mechanism 161 for each kind (color) of the ink. When the third concave portion 162 and the first concave portion 158 are not installed, it is necessary to provide an ink flow passage switching mechanism that switches the kind of ink flowing in the third concave portion 162 which is the ink chamber inside the flow passage opening and closing mechanism 165 and the first concave portion 158 which is the ink chamber inside flow passage internal pressure adjustment mechanism 161 on the assumption that a timing of the wiping on the nozzle surface is switched for each kind of ink. On the other hand, since the air for displacing the first flexible member 160 and the second flexible member 164 is common to the third concave portion 162 inside the flow passage opening and closing mechanism 165 and the first concave portion inside the flow passage internal pressure adjustment mechanism 161, it is not necessary to provide the ink flow passage switching mechanism for each kind (color) of the ink.

Accordingly, the third concave portion 162 inside the flow passage opening and closing mechanism 165 installed for each kind of ink may communicate with the air flow passage or may serve as a common air chamber. Likewise, the first concave portion 158 inside the flow passage internal pressure adjustment mechanism 161 installed for each kind of ink may communicate with the air flow passage or may serve as a common air chamber. However, when the concave portion serves as the common air chamber, the volume is increased, and thus the effect of air pressurization on the pressure reception area of the flexible member may is decreased. On the other hand, when an air chamber is installed for each kind of ink, the volume of the air chamber is not too large, and thus the effect of the pressurization is not decreased.

When the operation of releasing the negative pressure is performed, it is necessary 1) to close the flow passage by the displacement of the second flexible member 164 inside the flow passage opening and closing mechanism 165, and subsequently 2) to decrease the volume of the flow passage by the displacement of the first flexible member 160 inside the flow passage internal pressure adjustment mechanism 161. Therefore, the fourth concave portion 163 inside the flow passage opening and closing mechanism 165 and the second concave portion 159 inside the flow passage internal pressure adjustment mechanism 161 may not serve as a common air chamber. When the air chambers communicate with each other, it is necessary to provide an air flow passage switching mechanism.

The operation of the flow passage opening and closing mechanism 165 is performed by switching the pressurization and depressurization of the fourth concave portion (the air chamber) 163 inside the flow passage opening and closing mechanism 165. When the flow passage of the third concave portion (the ink chamber) 162 inside the flow passage opening and closing mechanism 165 is closed, the pressurization is performed. When the closing of the flow passage is released, atmosphere opening is performed. To quicken response of the opening and closing of the flow passage, the closing may be released through the depressurization in addition to (instead of) the atmosphere opening.

In a case in which the nozzle opening surface is capped (enclosed) by the cap and the ink inside the head is forcibly discharged by causing the pressure of the inside of the enclosed space to be negative through suction of a suction pump installed on the side of the cap, the depressurization is performed when choking is not desired to be performed. The depressurization is performed when the choking is desired to be performed. When the suction is performed in the choked state, the negative pressure gathers inside the head body 6. Thus, it is possible to pass a bubble staying in the flow passage on the upstream side from the filter portion 6B1 of the filter mechanism 6B installed on the downstream side from the flow passage opening and closing mechanism 165 to pass through the filter to be discharged.

When the second flexible member 164 for each kind of ink is on the same plane as that of the flow passage opening and closing mechanisms 165, the second flexible members 164 for the respective kinds of ink can be configured as a single member. That is, one flexible member may have a size necessary for the number of kinds of ink. The same also applies to the first flexible members 160 of the flow passage internal pressure adjustment mechanisms 161. The ink flow passage supplying the ink to the flow passage opening and closing mechanism 165 or the flow passage internal pressure adjustment mechanism 161 is also disposed on the plane on which the flexible member inside the flow passage opening and closing mechanism 165 or the flow passage internal pressure adjustment mechanism 161 is installed. Since the ink flow passage, and the flow passage opening and closing mechanism 165 or the flow passage internal pressure adjustment mechanism 161 are formed as the same member and these members are laminated, the ink flow passage is divided on the plane on which the flexible member is installed. An O ring may be used to seal the divided ink flow passages, but the O ring may also be installed as a single member along with the rubber inside the flow passage opening and closing mechanism 165 or the flow passage internal pressure adjustment mechanism 161.

In the foregoing embodiment, the case in which the self-sealing unit 4 is used as the negative pressure generation mechanism has been described. As a form of the generation of the negative pressure, a negative pressure inside a cartridge may be used or a head pressure difference may be used by adjusting the position of a tank of which a flow passage communicates with the head body 6 with respect to the head body 6. The point is that the inside of the liquid flow passage of the head body 6 may be configured to be under the negative pressure.

Another Embodiment of Flow Passage Opening and Closing Mechanism 165

Figure 13A:
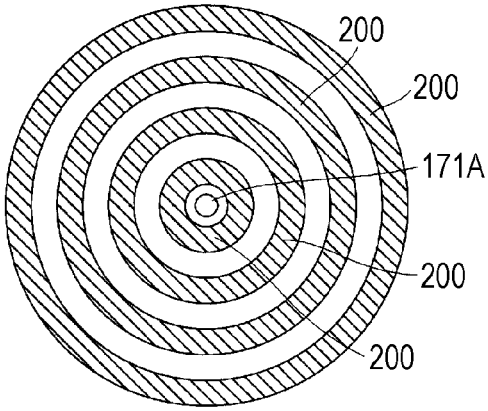
FIGS. 13A to 13C are diagrams schematically illustrating a schematic configuration of a flow passage opening and closing mechanism according to another embodiment.
Figure 13B:
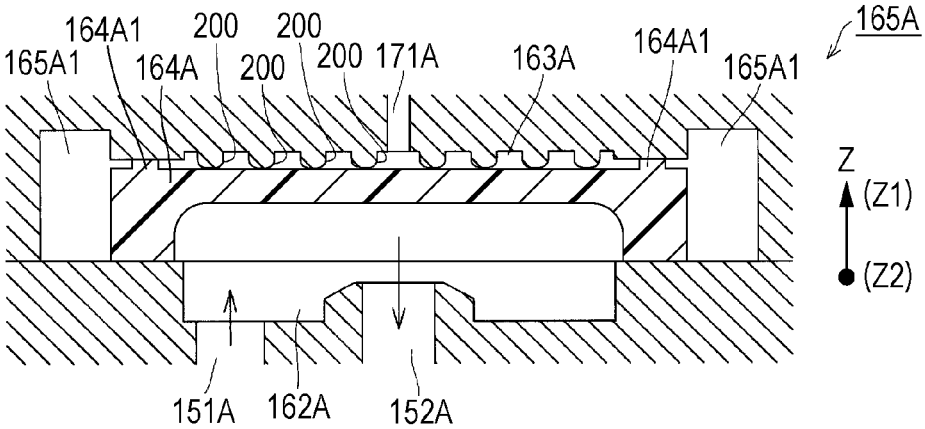
Figure 13C:
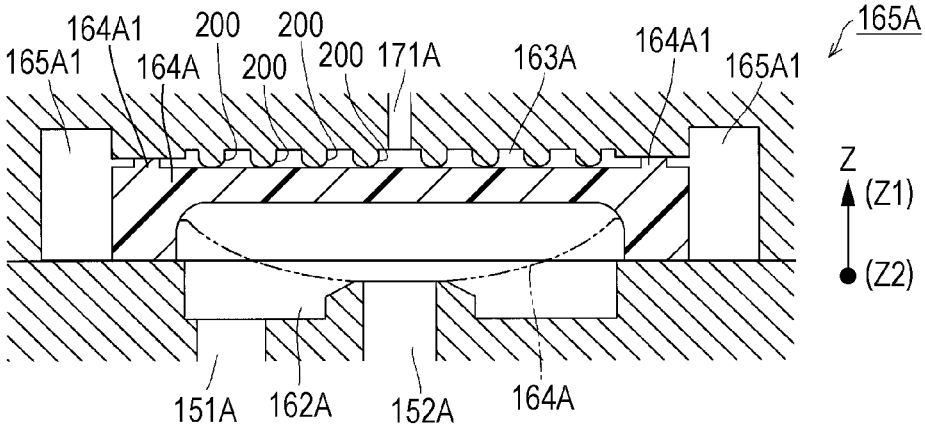

As another embodiment of the flow passage opening and closing mechanism 165 of the liquid ejecting head 3 and the recording apparatus 100 according to the foregoing embodiment, a configuration illustrated in FIGS. 13A to 13C is useful. The flow passage opening and closing mechanism will be described with reference to the drawings. The same reference numerals are given to the same portions as those in FIGS. 1 to 11B and the repeated description will be omitted.

FIGS. 13A to 13C are diagrams schematically illustrating a schematic configuration of the flow passage opening and closing mechanism. As illustrated in the drawings, a flow passage opening and closing mechanism 165A according to the embodiment includes a third concave portion 162A, a fourth concave portion 163A, and a second flexible member 164A. Here, the third concave portion 162A communicates with the head body 6 (see FIG. 2) and stores ink. The fourth concave portion 163A communicates with a fluid supply source (not illustrated) supplying an air which is a fluid for operating the flow passage opening and closing mechanism 165A via the air flow passage 171A, stores the air, and faces the third concave portion 162A. The second flexible member 164A is a discoid flexible member that is interposed between the third concave portion 162A and the fourth concave portion 163A and is formed of a rubber or the like sealing the third concave portion 162A and the fourth concave portion 163A. More specifically, the second flexible member 164A forms the fourth concave portion 163A serving as an air chamber by enclosing a space on the middle side of the second flexible member 164A via a seal portion 164A1. Here, the lower end of an air flow passage 171A is opened to the middle of the fourth concave portion 163A.

Thus, when a pressurized air is supplied to the fourth concave portion 163A which is an enclosed space via the air flow passage 171A, the middle of the second flexible member 164A is pressurized and deformed from the Z1 side to the Z2 side in the third direction Z, comes into contact with an opening of a flow passage 152A, as indicated by a two-dot chain line in FIG. 13C, and closes the flow passage 152A. As a result, flow of the ink directed from the flow passage 152A to the head body 6 (see FIG. 2) via the third concave portion 162A is stopped from a flow passage 151A at the normal time which is a state in which the flow passage opening and closing mechanism 165A is opened. Choking suction is performed in this state.

Here, in the embodiment, a circular space 165A1 of the second flexible member 164A is formed and predetermined deformation of the second flexible member 164A is ensured. However, this is not necessarily necessary.

In the embodiment, the volume of the fourth concave portion 163A is configured to be less than that of the third concave portion 162A. Thus, by causing the volume of the fourth concave portion 163A to be relatively small, a change in the volume of the flow passage in association with the opening and closing of the flow passage opening and closing mechanism 165A can be set to be small. In particular, when the inside of the flow passage is sucked in the state in which the flow passages 151A and 152A are closed by a flow passage opening and closing mechanism 351 (see FIG. 1) installed on the supply side (the side of the ink cartridge 350 (see FIG. 1)), the third concave portion 162A is depressurized and the second flexible member 164A comes into contact with the third concave portion 162A in some cases in order to prevent the second flexible member 164A from closing the flow passage in association with the negative pressure of the suction. That is, the suction is performed in the contact state. However, even in this case, when the volume of the fourth concave portion 163A is small, a change in the volume of the flow passage between the depressurization inside the third concave portion 162A and the releasing of the depressurization can be small.

In the fourth concave portion 163A according to the embodiment, convex portions 200 are formed at positions coming into contact with the second flexible member 164A. This will be described particularly with reference to FIG. 13A. In FIG. 13A, a ceiling portion of the fourth concave portion 163A is viewed from the Z2 side to the Z1 side in the third direction Z. As illustrated in the drawing, the convex portions 200 are circular portions protruding from the Z1 side to the Z2 side in the third direction from the ceiling portion of the fourth concave portion 163A and are formed as a plurality of convex portions (four convex portions in the embodiment) arranged in a concentric circular shape.

By installing the convex portions 200 in this way, it is possible to bring the second flexible member 164A into contact with the convex portions 200 and regulate the position of the second flexible member 164A. Therefore, it is possible to prevent the second flexible member 164A from being continuously attached to the ceiling portion of the fourth concave portion 163A and cause the position of the second flexible member 163A of the fourth concave portion to be the same between the normal time and the depressurization time.

The convex portions 200 formed in the concentric circular shape are not limited to the structure in the embodiment. As long as the position of the surface of the second flexible member 164A can be regulated at the normal time, further limitation is not necessary. For example, a structure in which a plurality of independent convex portions are installed in the ceiling portion of the fourth concave portion 163A may be realized.

Another Embodiment of Liquid Ejecting Head

Figure 14:
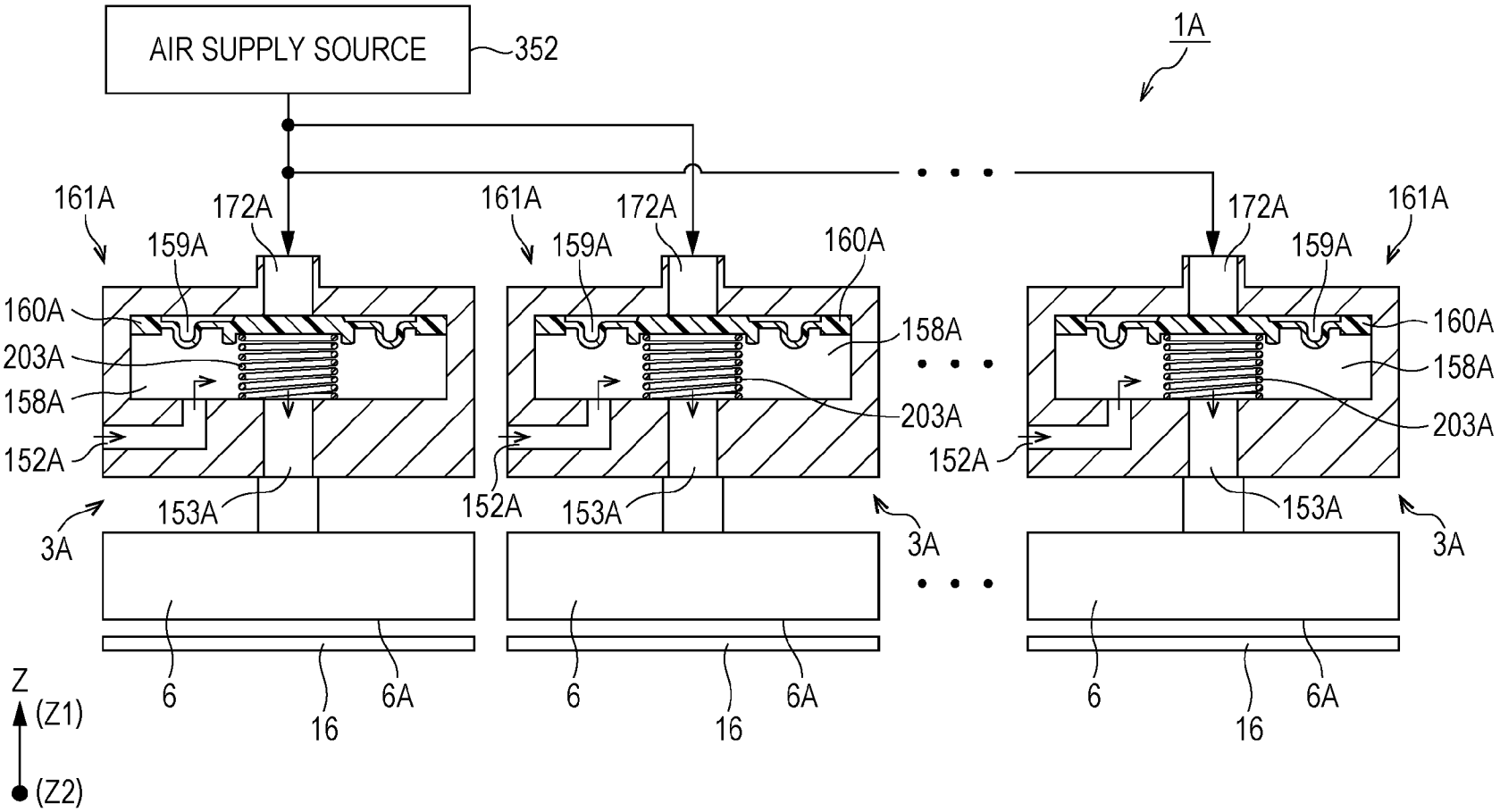
FIG. 14 is a diagram schematically illustrating a schematic configuration of a liquid ejecting head according to another embodiment.

FIG. 14 is a diagram schematically illustrating a schematic configuration of a liquid ejecting head according to the embodiment. As illustrated in the drawing, a liquid ejecting head unit 1A according to the embodiment includes not only a plurality of liquid ejecting heads 3A but also a plurality of flow passage internal pressure adjustment mechanisms 161A communicating with the head bodies 6, respectively. As the details of each flow passage internal pressure adjustment mechanism 161A will be described below, the flow passage internal pressure adjustment mechanism 161A displaces the first flexible member 160A by a pressurized air supplied to the second concave portion 159 via the air flow passage 172A and pressurizes the flow passages 152A and 153A by the change in the volume of the first concave portion 158A in association with the displacement to release the negative pressure state. The suction mechanism 16 discharges a bubble by acting the negative pressure to the ejecting unit 6A of each head body 6 and sucking the ink inside the head body 6.

One air supply source 352 supplying the pressurized air to each flow passage internal pressure adjustment mechanism 161A via the air flow passage 172A is configured to supply an air of a predetermined pressure. That is, in the embodiment, one air supply source 352 is shared between the flow passage internal pressure adjustment mechanisms 161A.

Accordingly, the configuration can be simplified compared to the configuration in which a pressurization source such as the air supply source 352 is installed for each negative pressure releasing mechanism configured by the self-sealing units (see FIGS. 1 to 3C: the same applies below).

The pressure and the amount of air supplied from the air supply source 352 in the embodiment are set to match negative pressure releasing conditions of the flow passage internal pressure adjustment mechanism 161A for which negative pressure releasing conditions (which will be described below in detail) are the severest among the plurality of flow passage internal pressure adjustment mechanisms 161A. That is, when the pressures inside the respective flow passages 153A are adjusted by all of the flow passage internal pressure adjustment mechanisms 161A, the ink is structured to be ejected from the ejecting units 6A corresponding to all of the flow passage internal pressure adjustment mechanisms 161A in association with the change in the volume in the respective flow passage internal pressure adjustment mechanisms 161A.

Thus, even when an excluded volume necessary for the releasing of the negative pressure differs for each negative pressure releasing mechanism such as the self-sealing unit 4 or each head body 6 corresponding to the negative pressure releasing mechanism, the excluded volume can be reliably formed so that the releasing of the negative pressure can be reliably performed on all of the negative pressure releasing mechanisms or head bodies 6 while the liquid is permitted to be ejected from the negative pressure releasing mechanism or the head body 6 in which the necessary excluded volume is small. As a result, it is possible to reliably perform the releasing of the negative pressure. That is, when each flow passage internal pressure adjustment mechanisms 161A is driven to perform a negative pressure releasing operation under the above-described conditions, there is a probability of the certain ejecting unit 6A ejecting the ink, but the releasing of the negative pressure can be reliably performed in all of the head bodies 6. Here, in the embodiment, the ejected ink is collected to the cap of the suction mechanism 16 so that the floor surface of the apparatus body 2 is not stained.

Even in the liquid ejecting head 1A according to the embodiment, although not illustrated, each flow passage opening and closing mechanism 165 (see FIG. 2) communicating with each flow passage 152A is installed on the upstream side of each flow passage internal pressure adjustment mechanism 161A.

Next, the configuration of the flow passage internal pressure adjustment mechanism 161A will be described in detail. The flow passage internal pressure adjustment mechanism 161A includes a first concave portion 158A, a second concave portion 159A, and a first flexible member 160A. The first concave portion 158A communicates with the head body 6 and stores the ink. The second concave portion 159A communicates with the air supply source 352 supplying an air which is a fluid for operating the flow passage internal pressure adjustment mechanism 161A via the air flow passage 172A. Thus, the second concave portion 159A stores the air and faces the first concave portion 158A via the first flexible member 160A. The first flexible member 160A is a discoid member that is interposed between the first concave portion 158A and the second concave portion 159A and is formed as a flexible member such as a rubber sealing the first concave portion 158A and the second concave portion 159A. The first flexible member 160A is normally urged toward the second concave portion 159A by a spring 203A which is an urging mechanism. As a result, the volume of the first concave portion 158A, that is, the volume of the flow passage internal pressure adjustment mechanism 161A, is typically maximum. On the other hand, the lower end of the air flow passage 172A is opened to the middle of the second concave portion 159A. Thus, when the pressurized air is supplied to the second concave portion 159A which is an enclosed space via the air flow passage 172A, the first flexible member 160A is pressurized and deformed against a spring force of the spring 203A from the Z1 side to the Z2 side in the third direction Z. As a result, the volume of the first concave portion 158A is decreased, the ink inside the flow passage 153A communicating with the head body 6 is pressurized, and the negative pressure inside the flow passage 153A is released.

The negative pressure releasing conditions differ in each flow passage internal pressure adjustment mechanism 161A. That is, the excluded volume in the first concave portion 158A necessary for the releasing of the negative pressure in the flow passage internal pressure adjustment mechanism 161A and a pressurization amount from the air supply source 352 for realizing the excluded volume are decided using 1) the negative pressure releasing mechanism such as the self-sealing unit 4 (see FIGS. 1 and 3A to 3C) or performance in the initial state such as an influence of the compliance inside the head body 6 corresponding to the negative pressure releasing mechanism and 2) a bubble amount inside the liquid ejecting head 3A as main parameters. Accordingly, in the embodiment, predetermined worst conditions for the predetermined releasing of the negative pressure by the flow passage internal pressure adjustment mechanism 161A are obtained. In the worst conditions, the air pressure and the volume of the first concave portion 158A are decided to perform the predetermined releasing of the negative pressure.

More specifically, the maximum bubble amount in the conditions can be specified by calculation or actual measurement. The performance of the negative pressure mechanism such as the self-sealing unit 4 can be specified by a standard and actual measurement. Accordingly, in the worst conditions specified by the calculation, the standard, and the actual measurement, the volume of the first concave portion 158A for deformation until the first flexible member 160A is stuck to the inner circumferential surface of the first concave portion 158A is obtained in consideration of stretch of the first flexible member 160A and the air pressure is decided.

Figure 15A:
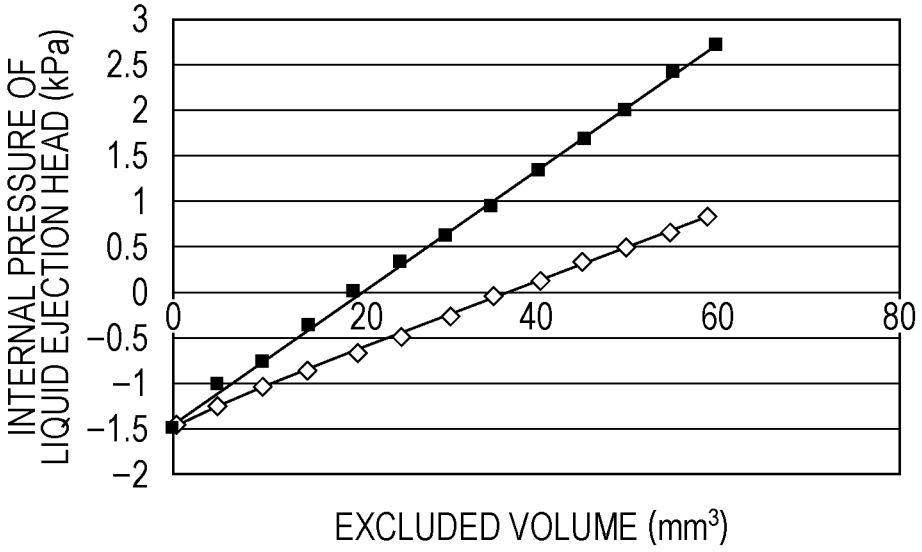
FIGS. 15A and 15B are characteristic diagrams illustrating the characteristics of a flow passage pressure adjustment mechanism illustrated in FIG. 14.
Figure 15B:
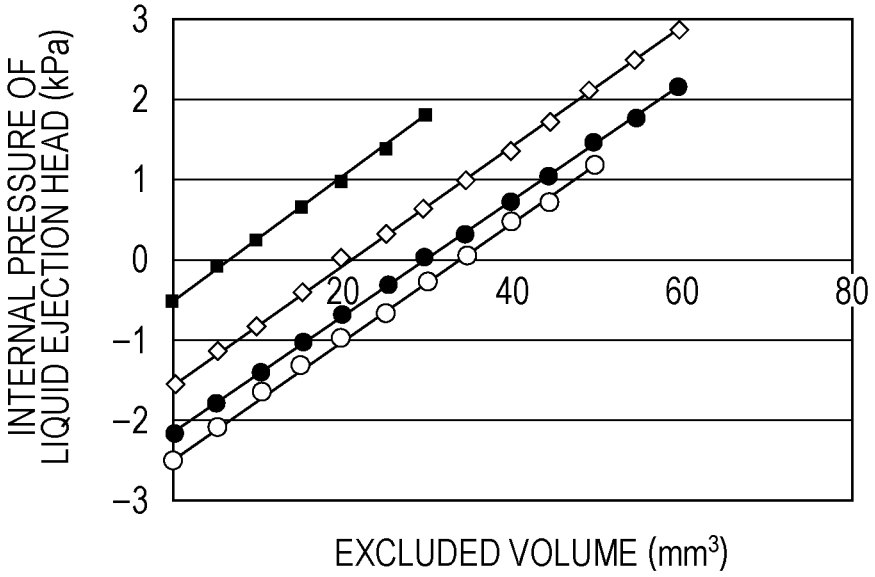

FIGS. 15A and 15B are graphs illustrating the characteristics of the flow passage pressure adjustment mechanism 161A. FIG. 15A shows a relation between the excluded volume of the ink in the first concave portion 158A and the internal pressure of the liquid ejecting head 3A when a bubble is present inside the liquid ejecting head 3A. In the drawing, ■ indicates a case in which a bubble is not present (actual measurement) and ◇ indicates a case of the maximum amount of bubble. Referring to the drawing, it can be understood that a slope of correlation between the excluded volume and the internal pressure of the liquid ejecting head 3A is changed according to the size of the bubble in the liquid ejecting head 3A, and the slope decreases as the bubble amount increases. Accordingly, an amount indicated by white ◇ is used as the bubble amount. FIG. 15B shows a relation between the excluded volume of the ink in the first concave portion 158A and the internal pressure of the liquid ejecting head 3A by a difference in the initial negative pressure in the self-sealing unit 4. In the drawing, initial values decrease in order ◇, ●, and ○ from ■. Referring to the drawing, it can be understood that the intercept of the correlation between the excluded volume and the internal pressure of the liquid ejecting head 3A is decided by the initial value of the internal pressure of the liquid ejecting head 3A. Accordingly, the characteristics of ○ are used as the worst conditions.

The maximum value of the volume change amount of the first concave portion 158A for which the releasing of the negative pressure is possible is obtained using the parameters even in the worst conditions and the air pressure by which the volume change amount can be realized is decided, as described above. Here, to uniformly give the air pressure in each flow passage internal pressure adjustment mechanism 161A, in the embodiment, a supply system capable of pressurizing each liquid ejecting head 3A from one air supply source 352 via the air flow passage 172A is provided, as described above. Here, the volume change amount of one first flexible member 160A enables deformation up to the sticking to the inner circumferential surface of the first concave portion 158A in consideration of the stretch of the rubber which is the material.

Another Embodiment of Liquid Ejecting Apparatus

Figure 16:
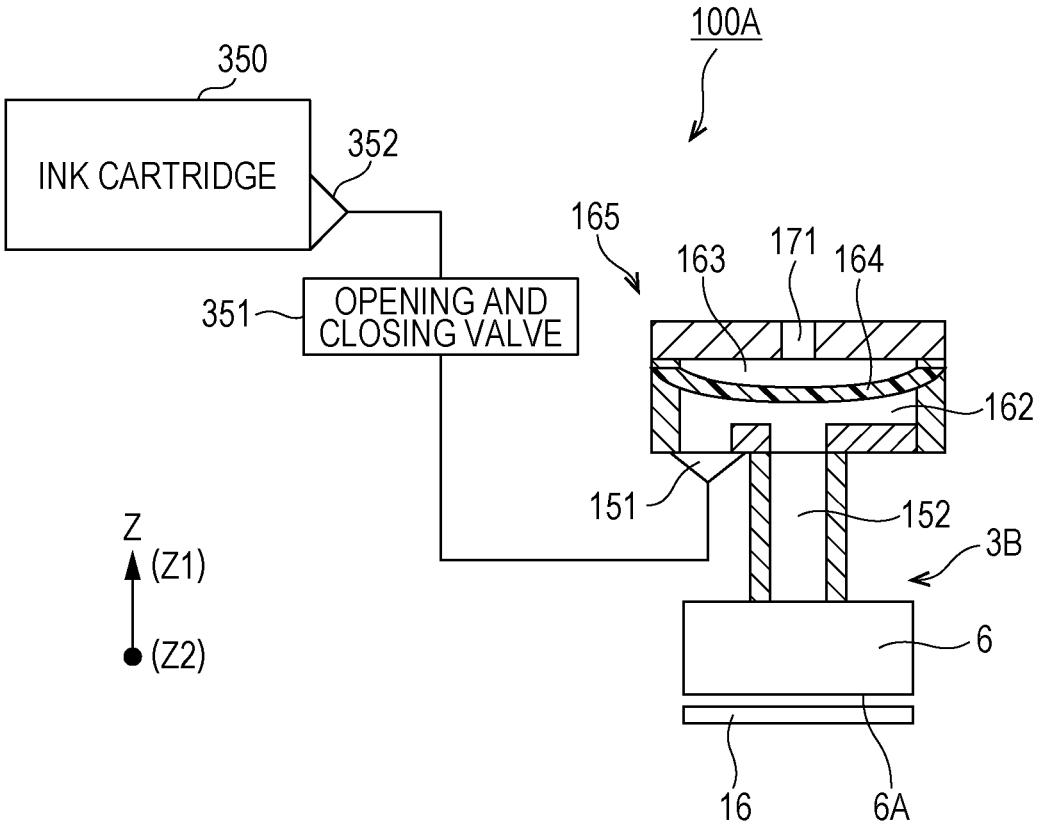
FIG. 16 is a diagram schematically illustrating a schematic configuration of a liquid ejecting apparatus according to another embodiment.

FIG. 16 is a diagram schematically illustrating a schematic configuration of a liquid ejecting apparatus according to another embodiment of the invention. As illustrated in the drawing, the liquid ejecting apparatus 100A according to the embodiment includes the ink cartridge 350 which is a liquid supply source, a liquid ejecting head 3B including a flow passage opening and closing mechanism 165 a head body 6 and which is a first flow passage opening and closing mechanism, and a suction mechanism 16. The other mechanisms are not illustrated. Here, an opening and closing valve 351 which is a second opening and closing mechanism is disposed between the flow passage 352 connected to the outlet side of the ink cartridge 350 and the flow passage 151 extending to the inlet side of the flow passage opening and closing mechanism 165. That is, the opening and closing valve 351 opens and closes a space between the flow passage 352 and the flow passage 151 on the upstream side (the side of the ink cartridge 350) of the flow passage opening and closing mechanism 165.

The flow passage opening and closing mechanism 165 is disposed between the flow passage 151 and the flow passage 152 extending from the flow passage opening and closing mechanism 165 to the head body 6. The flow passage opening and closing mechanism 165 is an opening and closing valve having the same configuration as the configuration illustrated in FIG. 2 or 4. That is, the second flexible member 164 is moved from the Z2 side to the Z1 side in the third direction Z by the pressurized air supplied to the fourth concave portion 163 via the air flow passage 171 to close the space between the flow passages 151 and 152, and the pressurization is released and depressurization is performed to open between the flow passages 151 and 152 and permit the flow of the ink oriented from the flow passage 151 to the flow passage 152.

Accordingly, in the embodiment, when the flow passage 152 is opened by the flow passage opening and closing mechanism 165 under the control of the control device 17, an operation is performed in a first mode in which the suction mechanism 16 performs suction in the state in which the flow passage 352 is closed by the opening and closing valve 351 and an operation is performed in a second mode in which the suction mechanism 16 performs suction in the state in which the flow passage 151 is closed by the flow passage opening and closing mechanism 165.

In this way, the suction of the first and second modes, that is, choking suction, can be performed properly at a desired timing in the embodiment. In the first mode, the ink on the downstream side of the opening and closing valve 351 is sucked. In the second mode, the ink on the downstream side of the flow passage opening and closing mechanism is sucked. Accordingly, in the case of the second mode, desired bubble exhaust can be performed by a small ink consumption amount. Simultaneously, since the distance of the flow passage is short, a larger negative pressure can be applied to the inside of the head body 6, and thus excellent exhaust can be realized. When the initial filling is performed, the exhaust property at the time of the initial filling can be improved by performing the suction of the first mode, and subsequently performing the suction of the second mode. Further, by performing not only the suction at the time of the initial filling but also the exhaust during a subsequent printing operation by the effectiveness of the first mode, it is possible to reduce unnecessary waste of the liquid associated with the suction operation as much as possible.

In the operation of the first mode, control can be performed such that the flow passage 151 is continuously opened by the flow passage opening and closing mechanism 165. In this case, on the assumption that one of the atmosphere opening, the depressurization, and the pressurization is performed, the fourth concave portion 163 filled with the air of the flow passage opening and closing mechanism 165 is 1) pressurized when the flow passage 151 is closed, 2) opened to the atmosphere or depressurized when the flow passage 151 is opened, and 3) depressurized when the suction is performed from the ejecting unit 6A. In particular, as the effect of the case of 3), there is a probability of the second flexible member 164 being drawn by the suction from the ejecting unit 6A and closing the flow passage 151 unintentionally, but this can be prevented by performing the depressurization.

In the foregoing embodiment, the liquid ejecting apparatus includes one pair of rails 11A and 11B and the cleaning mechanism 14, but the invention is not limited thereto. The liquid ejecting head unit 1 may be included. The head body 6 may include a pressure generation mechanism that causes a change in the pressure to occur in the ink inside the pressure generation chamber and the pressure generation chamber.

The flow passage opening and closing mechanism 165 closes or opens the ink flow passage of the third concave portion 162 by displacing the second flexible member 164 in order to open and close the flow passage so that the change in the volume inside the flow passage by the flow passage internal pressure adjustment mechanism 161 is not absorbed on the upstream side from the flow passage opening and closing mechanism 165, but the invention is not limited thereto. That is, when the change in the volume inside the flow passage by the flow passage internal pressure adjustment mechanism 161 is not absorbed on the upstream side from the flow passage opening and closing mechanism 165, the liquid flow passage may not completely closed by the opening and closing of the flow passage opening and closing mechanism 165. For example, the flow passage resistance between the flow passage internal pressure adjustment mechanism 161 and the negative pressure generation mechanism by the opening and closing of the flow passage opening and closing mechanism 165 may be able to be switched between a small state and a large state. Thus, the pressure loss during printing can be reduced and the change in the volume inside the flow passage by the flow passage internal pressure adjustment mechanism 161 may not be absorbed on the upstream side from the flow passage opening and closing mechanism 165. That is, the case in which the flow passage is closed by the flow passage opening and closing mechanism 165 includes not only the case in which the flow passage is completely closed but also the case in which the flow passage resistance of the flow passage is switched from the small state to the large state. The same applies to a case in which the flow passage opening and closing mechanism 165 is used to reduce the entire volume inside the flow passage with respect to the volume change amount by the flow passage internal pressure adjustment mechanism 161.

In the foregoing embodiment, a so-called line type recording apparatus in which the liquid ejecting head unit 1 is fixed to the apparatus body 2 and printing is performed merely by transporting the recording sheet S has been exemplified as the ink jet recording apparatus 100, but the invention is not particularly limited thereto. The invention can also be applied to a so-called serial type recording apparatus in which the liquid ejecting head 3 is mounted on a carriage moved in a direction intersecting the first direction X which is a transport direction of the recording sheet S, for example, in the second direction Y, and printing is performed while the liquid ejecting head 3 is moved in the direction intersecting the transport direction.

In the foregoing embodiment, the invention has been described exemplifying the ink jet recording head that ejects ink droplets, but the invention is devised for universal and general liquid ejecting heads. Examples of the liquid ejecting head include a recording head used in an image recording apparatus such as a printer, a color material ejecting head used to manufacture a color filter of a liquid crystal display or the like, an electrode material ejecting head used to form an electrode of an organic EL display, a field emission display (FED), or the like, and a bio-organism ejecting head used to manufacture a bio chip.

What is claimed is:

1. A flow passage member used in a liquid ejecting head including an ejecting unit that ejects a liquid via a nozzle opening through driving of a driving element, wherein the ejecting unit communicates with a negative pressure generation mechanism configured to maintain a negative pressure of the ejecting unit, wherein the flow passage member comprises:

a flow passage internal pressure adjustment mechanism configured to adjust a pressure inside a flow passage between the negative pressure generation mechanism and the ejecting unit by changing a volume of the flow passage therebetween; and a valve configured to open and close a flow passage between the negative pressure generation mechanism and the flow passage internal pressure adjustment mechanism, wherein the flow passage internal pressure adjustment mechanism includes a first concave portion that communicates with the valve and the ejecting unit and stores a liquid, a second concave portion that communicates with a first fluid supply source, stores a fluid, and faces the first concave portion, and a first flexible member that is interposed between the first and second concave portions and seals the first and second concave portions, and wherein when the flow passage is closed by the valve, the first flexible member is deformed by the fluid supplied from the first fluid supply source and a volume of a portion partitioned by the first concave portion and the first flexible member is changed to adjust the pressure inside the flow passage, wherein the liquid ejecting head includes a second fluid supply source configured to supply a fluid for driving the valve, and wherein the valve is configured to open and close the flow passage by the fluid supplied from the second fluid supply source.

2. The flow passage member according to claim 1, wherein the flow passage internal pressure adjustment mechanism is configured to adjust a pressure inside the first concave portion by air supplied from the first fluid supply source.

3. The flow passage member according to claim 1, wherein an outlet of the liquid from the first concave portion of the flow passage internal pressure adjustment mechanism is located on an upper side in a vertical direction.

4. The flow passage member according to claim 1, wherein the flow passage internal pressure adjustment mechanism further includes a first urging mechanism configured to urge the first flexible member from a side of the first concave portion to a side of the second concave portion.

5. The flow passage member according to claim 1, wherein the valve includes a third concave portion that communicates with the negative pressure generation mechanism, communicates with the flow passage internal pressure adjustment mechanism, and stores the liquid, a fourth concave portion that communicates with the second fluid supply source, stores the fluid, and faces the third concave portion, and a second flexible member that is interposed between the third and fourth concave portions and seals the third and fourth concave portions, and wherein the valve is configured to deform the second flexible member by the fluid supplied from the second fluid supply source to open and close the flow passage.

6. The flow passage member according to claim 5, wherein the second flexible member is configured to open the flow passage when the fluid is not supplied from the second fluid supply source.

7. The flow passage member according to claim 5, wherein the valve further includes a second urging mechanism that urges the second flexible member from a side of the third concave portion to a side of the fourth concave portion.

8. The flow passage member according to claim 1, wherein the second fluid supply source supplies the fluid pressurized when the flow passage is closed by the valve and supplies the fluid depressurized when the flow passage is opened by the valve.

9. The flow passage member according to claim 1, wherein the negative pressure generation mechanism includes a flexible member that is displaceable according to the ejection of the liquid from the ejecting unit, and wherein the valve is configured to close the flow passage when the pressure inside the flow passage is adjusted by the flow passage internal pressure adjustment mechanism, so that the flexible member of the negative pressure generation mechanism is not displaced through the adjustment of the pressure by the flow passage internal pressure adjustment mechanism.

10. A liquid ejecting head comprising:

an ejecting unit; and the flow passage member according to claim 1.

11. A liquid ejecting apparatus comprising:

a negative pressure generation mechanism; and the liquid ejecting head according to claim 10.

12. The liquid ejecting apparatus according to claim 11, further comprising:

a suction mechanism configured to suck the liquid from the nozzle opening communicating with the ejecting unit, wherein the valve includes a control mechanism configured to sequentially perform a first mode in which the flow passage is in a closed state, a second mode in which the flow passage is switched from the closed state to an opened state, and a third mode in which the flow passage is in the opened state while the suction mechanism sucks the liquid.

13. The liquid ejecting apparatus according to claim 11, further comprising:

a collection mechanism configured to collect a foreign matter in the liquid on a way of a flow passage between the flow passage internal pressure adjustment mechanism and the ejecting unit.

14. A liquid ejecting apparatus comprising:

a liquid ejecting head that includes an ejecting unit ejecting a liquid via a nozzle opening through driving of a driving element;

a negative pressure generation mechanism that communicates with the ejecting unit and maintains a negative pressure of the ejecting unit;

a flow passage internal pressure adjustment mechanism configured to adjust a pressure inside a flow passage between the negative pressure generation mechanism and the ejecting unit by changing a volume of the flow passage therebetween; and a valve configured to open and close a flow passage between the negative pressure generation mechanism and the flow passage internal pressure adjustment mechanism, wherein the negative pressure generation mechanism includes a flexible member that is displaceable according to the ejection of the liquid from the ejecting unit, wherein the valve is configured to close the flow passage when the pressure inside the flow passage is adjusted by the flow passage internal pressure adjustment mechanism, and wherein the valve includes a third concave portion that communicates with the negative pressure generation mechanism, communicates with the flow passage internal pressure adjustment mechanism, and stores the liquid, a fourth concave portion that communicates with a second fluid supply source, stores the fluid, and faces the third concave portion, and a second flexible member that is interposed between the third and fourth concave portions and seals the third and fourth concave portions.

15. The liquid ejecting apparatus according to claim 14, wherein flow passage resistance from the valve to the negative pressure generation mechanism is less than flow passage resistance from the valve to the nozzle opening.

16. The liquid ejecting apparatus according to claim 14, wherein the flow passage internal pressure adjustment mechanism includes a first concave portion that communicates with the valve and the ejecting unit and stores a liquid, a second concave portion that communicates with a first fluid supply source, stores a fluid, and faces the first concave portion, and a first flexible member that is interposed between the first and second concave portions and seals the first and second concave portions.

17. The liquid ejecting apparatus according to claim 16, wherein the flow passage internal pressure adjustment mechanism further includes a first urging mechanism configured to urge the first flexible member from a side of the first concave portion to a side of the second concave portion.

18. The liquid ejecting apparatus according to claim 14, wherein the valve further includes a second urging mechanism configured to urge the second flexible member from a side of the third concave portion to a side of the fourth concave portion.

19. A flow passage member used in a liquid ejecting head including an ejecting unit that ejects a liquid via a nozzle opening through driving of a driving element, wherein the ejecting unit communicates with a negative pressure generation mechanism configured to maintain a negative pressure of the ejecting unit, wherein the flow passage member comprises:

a flow passage internal pressure adjustment mechanism configured to adjust a pressure inside a flow passage between the negative pressure generation mechanism and the ejecting unit by changing a volume of the flow passage therebetween; and a valve configured to open and close a flow passage between the negative pressure generation mechanism and the flow passage internal pressure adjustment mechanism, wherein the flow passage internal pressure adjustment mechanism includes a first concave portion that communicates with the valve and the ejecting unit and stores a liquid, a second concave portion that communicates with a first fluid supply source, stores a fluid, and faces the first concave portion, and a first flexible member that is interposed between the first and second concave portions and seals the first and second concave portions, wherein when the flow passage is closed by the valve, the first flexible member is deformed by the fluid supplied from the first fluid supply source and a volume of a portion partitioned by the first concave portion and the first flexible member is changed to adjust the pressure inside the flow passage, and wherein the valve includes a third concave portion that communicates with the negative pressure generation mechanism, communicates with the flow passage internal pressure adjustment mechanism, and stores the liquid, a fourth concave portion that communicates with a second fluid supply source, stores the fluid, and faces the third concave portion, and a second flexible member that is interposed between the third and fourth concave portions and seals the third and fourth concave portions, and wherein the valve is configured to deform the second flexible member by the fluid supplied from the second fluid supply source to open and close the flow passage.

20. The flow passage member according to claim 19, wherein the second flexible member is configured to open the flow passage when the fluid is not supplied from the second fluid supply source.

21. The flow passage member according to claim 19, wherein the valve further includes a second urging mechanism that urges the second flexible member from a side of the third concave portion to a side of the fourth concave portion.

* * * * *